US006672931B1

(12) United States Patent
Bagley

(10) Patent No.: US 6,672,931 B1
(45) Date of Patent: Jan. 6, 2004

(54) INTERCONNECTABLE MODEL CONSTRUCTION ELEMENTS

(76) Inventor: Jim Bagley, 9909 S. Dream Circle Dr., South Jordan, UT (US) 84095

( * ) Notice: Subject to any disclaimer, the term of this patent is extended or adjusted under 35 U.S.C. 154(b) by 138 days.

(21) Appl. No.: 09/712,108

(22) Filed: Nov. 14, 2000

(51) Int. Cl.[7] ..... A63H 33/08

(52) U.S. Cl. ..... 446/106; 446/107; 446/112; 446/116; 446/119; 446/120; 446/125; 446/126

(58) Field of Search ..... 446/85, 102–109, 446/111–116, 117–121, 122–126; D21/483–489, 490–491, 500–503, 505; 411/424, 427, 435, 436; 301/5.1, 5.301, 5.309

(56) References Cited

U.S. PATENT DOCUMENTS

| | | | | | |
|---|---|---|---|---|---|
| 1,198,263 | A | | 2/1916 | Pajeau | |
| 1,678,709 | A | * | 7/1928 | Schurmann | 446/104 |
| 1,851,159 | A | | 3/1932 | Dodge | |
| 3,233,358 | A | | 2/1966 | Dehm | |
| 3,452,989 | A | * | 7/1969 | Jerstrom | 144/3.1 |
| D219,230 | S | * | 11/1970 | Reijnhard et al. | D21/491 |
| 3,550,311 | A | | 12/1970 | Fouquart | |
| 3,552,257 | A | * | 1/1971 | Tanabe | 411/368 |
| 3,648,404 | A | | 3/1972 | Ogsbury et al. | |
| 3,690,656 | A | | 9/1972 | Hughes et al. | |
| 3,698,123 | A | | 10/1972 | Heldt | |
| 3,808,737 | A | | 5/1974 | Abrams | |
| 3,927,489 | A | | 12/1975 | Bernstein | |
| 4,078,328 | A | | 3/1978 | Rayment | |
| D254,752 | S | | 4/1980 | Gabriel | |
| 4,453,719 | A | * | 6/1984 | McKean | 273/265 |
| 4,548,590 | A | | 10/1985 | Green | |
| 4,606,732 | A | | 8/1986 | Lyman | |
| 4,701,131 | A | * | 10/1987 | Hildebrandt et al. | 434/211 |
| 4,740,188 | A | * | 4/1988 | Coster | 446/106 |
| 5,044,960 | A | | 9/1991 | De Porteous | |
| RE33,785 | E | * | 12/1991 | Hildebrandt et al. | 434/211 |
| 5,096,352 | A | * | 3/1992 | Lemelson | 411/424 |
| 5,121,526 | A | * | 6/1992 | Burkard et al. | 24/336 |
| 5,137,486 | A | | 8/1992 | Glickman | |
| D334,953 | S | | 4/1993 | Kawahara et al. | |
| 5,199,919 | A | | 4/1993 | Glickman | |
| 5,350,331 | A | * | 9/1994 | Glickman | 446/120 |
| 5,368,514 | A | | 11/1994 | Glickman et al. | |
| 5,383,715 | A | * | 1/1995 | Homma et al. | 301/5.23 |
| D364,199 | S | * | 11/1995 | Schmidt et al. | D21/488 |
| 5,487,691 | A | | 1/1996 | Chiu | |

(List continued on next page.)

FOREIGN PATENT DOCUMENTS

| | | |
|---|---|---|
| WO | WO 97/45183 | 12/1997 |

*Primary Examiner*—Jessica Harrison
*Assistant Examiner*—Alex F. R. P. Rada, II
(74) *Attorney, Agent, or Firm*—Morriss O'Bryant Compagni, P.C.

(57) ABSTRACT

A system of interconnectable construction elements created from molded plastic, and which include planar and cylindrical strut members of varying lengths and thicknesses which can be coupled together and to various construction elements of varying geometries, wherein the construction elements are capable of movement such as pivoting relative to an attached construction element, wherein cylindrical struts include regularly spaced ball structures and regularly spaced gaps therebetween, and wherein the planar and cylindrical struts include a variety of attaching means disposed on the ends thereof that are capable of coupling with complementary structures to thereby form a variety of models, shapes, patterns or designs.

24 Claims, 31 Drawing Sheets

U.S. PATENT DOCUMENTS

| | | | | | |
|---|---|---|---|---|---|
| D367,897 | S | | 3/1996 | Schmidt et al. | |
| 5,527,201 | A | | 6/1996 | Maddock | |
| 5,542,871 | A | * | 8/1996 | Gabriel | 24/615 |
| 5,605,486 | A | * | 2/1997 | Zheng | 273/156 |
| 5,645,463 | A | | 7/1997 | Olsen | |
| D394,091 | S | * | 5/1998 | Parry | D21/486 |
| 5,853,313 | A | * | 12/1998 | Zheng | 403/345 |
| D409,677 | S | | 5/1999 | Jensen | |
| 5,904,606 | A | | 5/1999 | Zimmer et al. | |
| D410,704 | S | * | 6/1999 | Krog | D21/486 |
| D410,973 | S | * | 6/1999 | Jensen | D21/486 |
| 5,928,051 | A | | 7/1999 | Krog | |
| 5,984,756 | A | | 11/1999 | Krog | |
| D420,710 | S | * | 2/2000 | Poulsen | D21/486 |
| 6,116,981 | A | * | 9/2000 | Zheng | 446/106 |
| 6,231,416 | B1 | * | 5/2001 | Clever et al. | 446/108 |
| 6,325,694 | B1 | * | 12/2001 | Clever et al. | 403/165 |

* cited by examiner

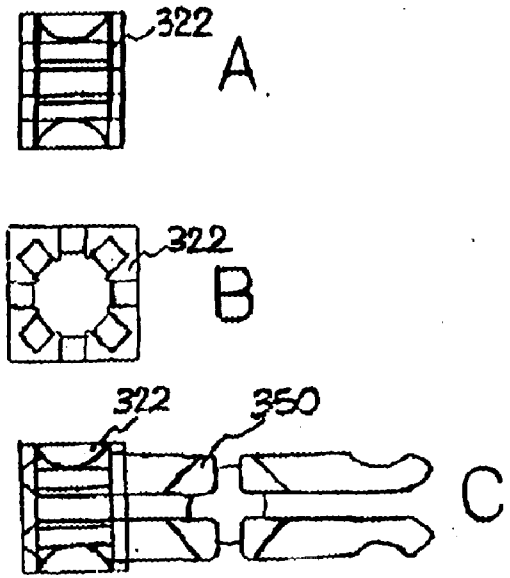
FIGS. 35A-C
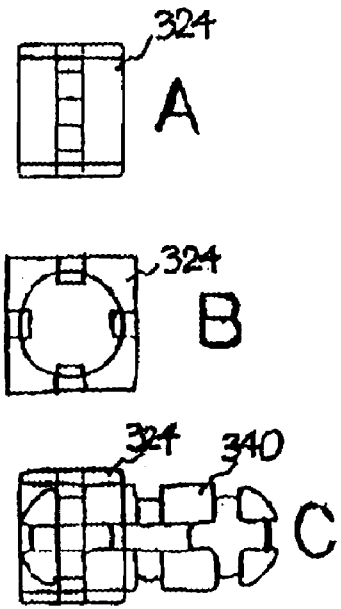
FIGS. 34A-C
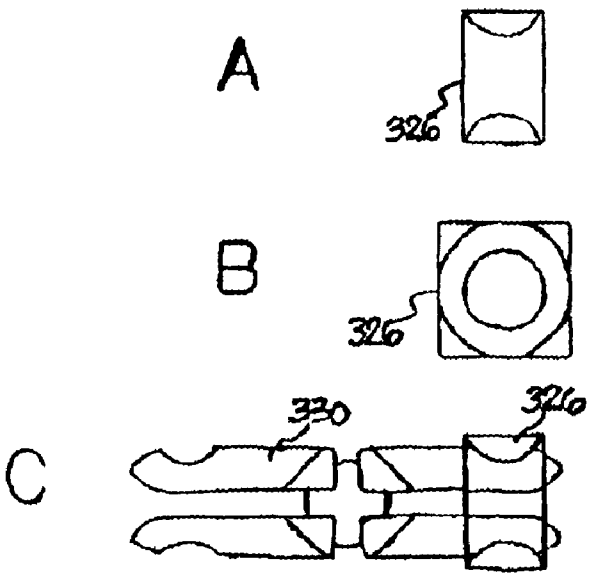
FIGS. 33A-C

INTERCONNECTABLE MODEL CONSTRUCTION ELEMENTS

BACKGROUND

1. The Field of the Invention

This invention relates generally to construction and model building toys. Specifically, the invention is a system of building elements that are coupled together to form various shapes. The building elements are a combination of unique strut members and three-dimensional platforms that are interconnectable. The unique shapes also enable movement of some building elements relative to other building elements when coupled.

2. The State of the Art

The state of the prior art is replete with building blocks and other similar types of toys that enable construction elements to be coupled together to build models, shapes, patterns or designs in three dimensions. While these construction elements are referred to as toys, it should not be assumed that they are simplistic devices. The construction elements are often complex, or capable of building complex shapes. Furthermore, they often include the ability to incorporate actuable elements such that they can be powered by mechanical or electrical devices. The result is that the construction elements are often minor engineering feats in and of themselves.

Given this introduction to so-called toy construction elements, it should not be surprising to realize that construction elements that are manufactured on a small scale are capable of rather amazing and even ingenious ways of interlocking to thereby form rather complex models, shapes, patterns and designs.

However, given the fact that there are many different types of construction elements, and that there are many different types of connection schemes that can be used to connect them, it should also not be surprising that new and advantageous construction elements and ways of connecting them together are still possible. In addition, the construction elements are not limited to bricks or beams. The construction elements include various shapes to which beam or brick-like members can be coupled.

Accordingly, it would be advantageous to provide a plurality of building elements that include new and advantageous means of building models, shapes, patterns or designs, where a great variety of construction elements enables an imaginative user to build simple and complex designs. It would also be an advantage to provide not only strut-like construction elements, but also various shapes and platforms to which the strut-like members can be coupled. Finally, it would be advantageous to provide a plurality of construction elements that can be actuated so as to pivot, rotate, and otherwise move relative to each other by application of mechanical force to thereby animate the models, shapes, patterns or designs.

OBJECT AND SUMMARY OF THE INVENTION

It is an object of the present invention to provide a new system of interconnectable construction elements that enable advantageous coupling therebetween.

It is another object to provide a new system of interconnectable construction elements wherein a strut member includes a plurality of evenly spaced ball structures that can receive a complementary gripping structure.

It is another object to provide a new system of interconnectable construction elements wherein the ball structures enable pivotal motion of a construction element that is coupled thereto.

It is another object to provide a new system of interconnectable construction elements wherein the ball structures include guiding or channeling structures thereon such that construction elements capable of pivoting motion will pivot along a plane defined by the channeling structures.

It is another object to provide a new system of interconnectable construction elements wherein a strut member includes regularly spaced gaps between the ball-like elements that enable complementary structures to be inserted therethrough so as to couple to the strut member.

It is another object to provide a new system of interconnectable construction elements wherein a strut member can be manufactured with a variety of different attaching means on ends thereof to enable the strut member to couple to a variety of complementary structures.

It is another object to provide a new system of interconnectable construction elements wherein a strut member is a relatively planar structure.

It is another object to provide a new system of interconnectable construction elements wherein the planar strut member includes apertures along a length thereof at regularly spaced intervals.

It is another object to provide a new system of interconnectable construction elements wherein a planar strut member having at least one aperture through a length thereof includes a plurality of dentations and indentations to thereby enable coupling between construction elements.

It is another object to provide a new system of interconnectable construction elements wherein the strut member is capable of functioning as an axle when coupled to a wheel shaped construction element.

It is another object to provide a new system of interconnectable construction elements wherein a relatively planar strut member can be manufactured with varying widths to thereby enable a plurality of strut members to be disposed in a location designed for a single full-thickness strut member.

It is another object to provide a new system of interconnectable construction elements wherein the construction elements can be coupled to each other in such a way that application of mechanical force to the construction elements can animate a model, shape, pattern or design.

It is another object to provide a new system of interconnectable construction elements wherein a first group of strut members have a length and various connecting locations which lend themselves to connections made at 45 and 90 degree angles.

It is another object to provide a new system of interconnectable construction elements wherein a second group of strut members have a length and various connecting locations which lend themselves to connections made at 30, 60 and 120 and 150 degree angles.

It is another object to provide a new system of interconnectable construction elements which include the ability to create a pneumatic pumping system, a pulley system, a mechanical gear system, a switching system, and a chain and sprocket system.

It is another object to provide a new system of interconnectable constructions elements which utilize electrical and pneumatic elements to provide movement thereof.

The above objects are realized in a specific illustrative embodiment of a system of interconnectable construction elements created from molded plastic, wood or metal, and which include planar and cylindrical strut members of varying lengths and thicknesses which can be coupled together and to various construction elements of varying geometries, wherein the construction elements are capable of movement such as pivoting relative to an attached construction element, wherein cylindrical struts include regularly spaced ball structures and regularly spaced gaps therebetween, and wherein the planar and cylindrical struts include a variety of attaching means disposed on the ends thereof that are capable of coupling with complementary structures to thereby form a variety of models, shapes, patterns or designs.

In accordance with a first aspect of the invention, a plurality of planar struts having regularly spaced apertures of various geometries along a length thereof, and including at least one means for coupling to another construction element.

In accordance with a second aspect of the invention, a plurality of cylindrical struts having regularly spaced ball structures and gaps therebetween along a length thereof, and including at least one means for coupling to another construction element.

These and other objects, features, advantages and alternative aspects of the present invention will become apparent to those skilled in the art from a consideration of the following detailed description taken in combination with the accompanying drawings.

BRIEF DESCRIPTION OF THE DRAWINGS

FIG. 33A is a profile view of one element from the base unit of FIG. 32.

FIG. 33B is a top view of one element from the base unit of FIG. 32.

FIG. 33C is a profile view of the element from the base unit having a cylindrical strut coupled thereto.

FIG. 34A is a profile view of one element from the base unit of FIG. 32.

FIG. 34B is a top view of one element from the base unit of FIG. 32.

FIG. 34C is a profile view of the element from the base unit having a cylindrical strut coupled thereto.

FIG. 35A is a profile view of one element from the base unit of FIG. 32.

FIG. 35B is a top view of one element from the base unit of FIG. 32.

FIG. 35C is a profile view of the element from the base unit having a cylindrical strut coupled thereto.

DETAILED DESCRIPTION OF THE INVENTION

Reference will now be made to the drawings in which the various elements of the present invention will be given numerical designations and in which the invention will be discussed so as to enable one skilled in the art to make and use the invention. It is to be understood that the following description is only exemplary of the principles of the present invention, and should not be viewed as narrowing the claims which follow.

The presently preferred embodiment of the invention has evolved substantially since its inception. Therefore, as the invention is explained, it is important to keep in mind that the various models, shapes, patterns or designs that can be created using the construction elements of the invention are numerous. Accordingly, the examples given hereinafter are only able to give a very brief introduction to many design possibilities. The purpose of the inventor was to free the user to create models, shapes, patterns or designs that are limited by the user's imagination, and not by the construction elements themselves.

As will be shown, the construction elements of the present invention are designed to provide a wide variety of means for making connections therebetween. Furthermore, the preferred embodiment also includes the ability to animate various construction elements. Therefore, the means for animating construction elements is also an integral part of the invention. A wide variety of animatable construction elements enables a user to be free to experiment.

The construction elements are generally manufactured from molded plastic as is commonly found in toys for children. The plastic is relatively rigid, but will bend or give slightly in order for construction elements to engage each other via friction. In other words, the construction elements will generally snap together, but may be required to slightly bend in order to insert or attach one construction element to another.

In addition, other materials can be used for the construction elements. For example, wood and metal are also suitable materials. Each material has properties which can lend themselves to particular applications. Accordingly, the materials that can be used are generally all those which can for the desired construction elements, as is known to those skilled in the art.

With this brief introduction, the elements of the presently preferred embodiment will now be described. The main construction elements of the invention are of several different types. These different types can be loosely referred to as struts, grids, and miscellaneous connecting and actuating elements. The struts will be described first.

Figure 1:
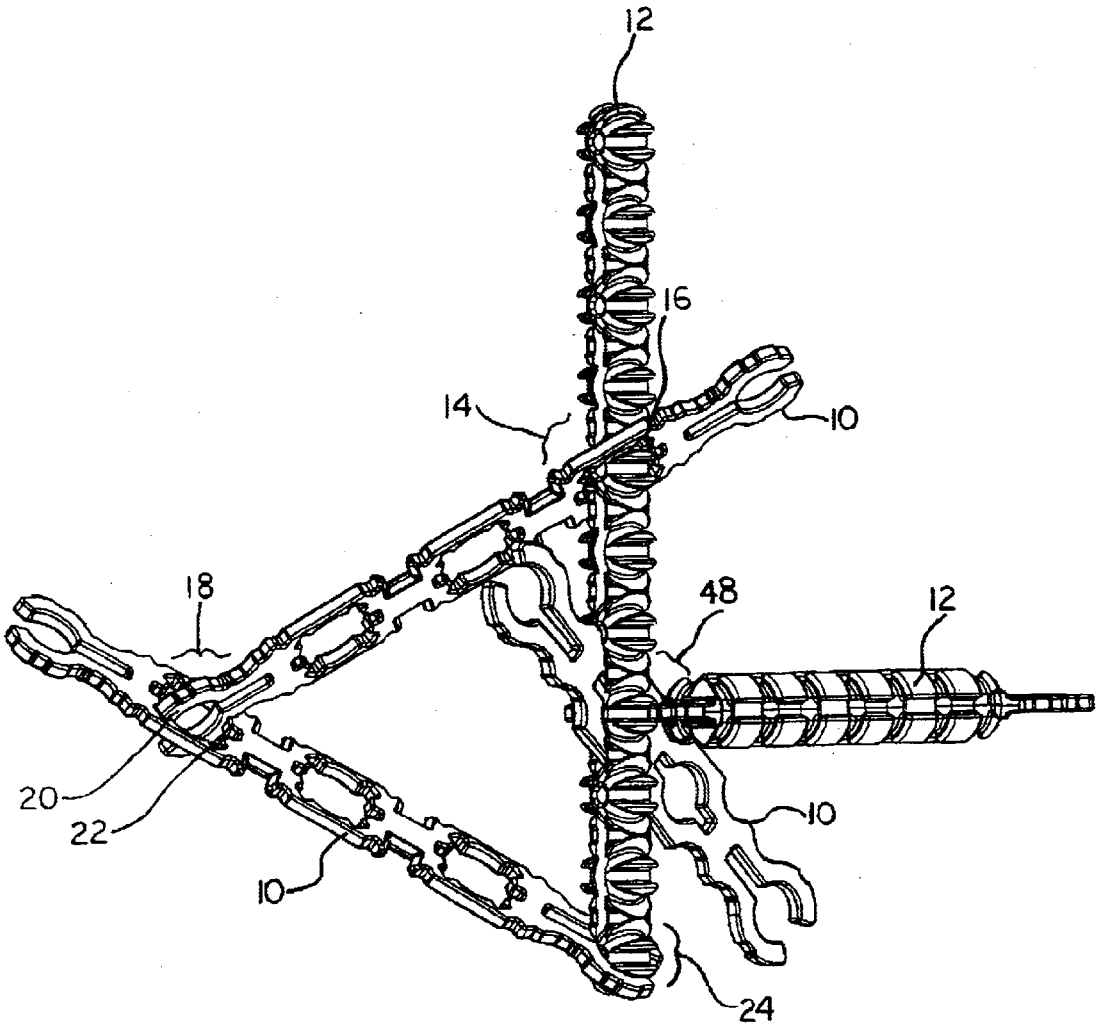
FIG. 1 is a perspective view of a plurality of planar struts and cylindrical struts that are coupled together at various angles, and which are made in accordance with the presently preferred embodiment of the invention.

The struts of the presently preferred embodiment are divided into two distinct types. The first type of strut has two relatively large and planar surfaces. The second type of strut is generally cylindrical in nature. FIG. 1 is provided as a three dimensional view of both the planar 10 and the cylindrical 12 struts. This figure is particularly useful in briefly illustrating several of the ways in which the struts 10, 12 can be coupled together. It should also be noted that there can be more than one type of planar strut 10 and cylindrical strut 12, as will be explained.

One aspect of the invention to be remembered is that the spacing of connection points on all construction elements of the present invention is based upon the desire to couple them together in many different combinations and angles. Thus, there are generally two types of spacing. The spacing of connection is either designed for 90 degree connections, or for diagonal connectors.

Accordingly, it is necessary to provide some struts having connection points that are spaced apart so that they can connect diagonally to other construction elements. For example, the connection points on one type of cylindrical strut can be spaced such that it can be coupled to two other struts that already form a 90 degree angle. The connection points on the strut forming the diagonal will be spaced farther apart than the connection points on the two struts that are forming the 90 degree angle. It is also observed that the number of connection points define the length of a particular construction element. The smallest construction element can be 1 unit in length, up to any desired number of units, limited only practical manufacturing limitations.

When examining FIG. 1, note that the struts 10, 12 are not restricted to simple 90 degree angles relative to each other. The struts 10, 12 are capable of forming surprising and unexpected angles and methods of interlocking. For example, at intersection 14, a cylindrical strut 12 is engaged with a planar strut 10, the cylindrical strut 12 having been moved a distance through an aperture 16 in the planar strut 10.

The planar strut 10 is also skewed at an angle on the cylindrical strut 12. To hold the planar strut 10 in place, it is engaged with a second planar strut 10 at intersection 18. At intersection 18, a C-claw shape 20 on the end of one of the planar struts 10 is not being used as a clamp, but is instead inserted through an aperture 22, and held there by friction. In other words, the aperture 22 is slightly smaller than the relaxed and unopposed resting shape of the C-claw shape 20. Thus, when inserted therein, the planar struts 10 are held in place not only by friction, but by dentations on the outer edges of the C-claw shape 20. These dentations will be shown more clearly in FIG. 2A.

It is noted that the dentations can be formed at various angles. While the most common angles are 90 and 45 degrees, any desired angle for a dentation can be provided.

The variety of the shapes used as connecting ends and apertures on and through the struts 10, 12 have evolved significantly since a first design. The shapes evolved in response to a desire that the various struts 10, 12 provide a large amount of variation in angles at which they are capable of connecting, and to provide a large number of shapes that they can connect to.

FIG. 1 illustrates several ways for connecting struts together. For example, the outside edges of the C-claw shape 20 can be disposed inside an opening or aperture 16 of another strut as shown at intersection 18 in FIG. 1, and then by friction, engage such an opening.

Figure 2A:
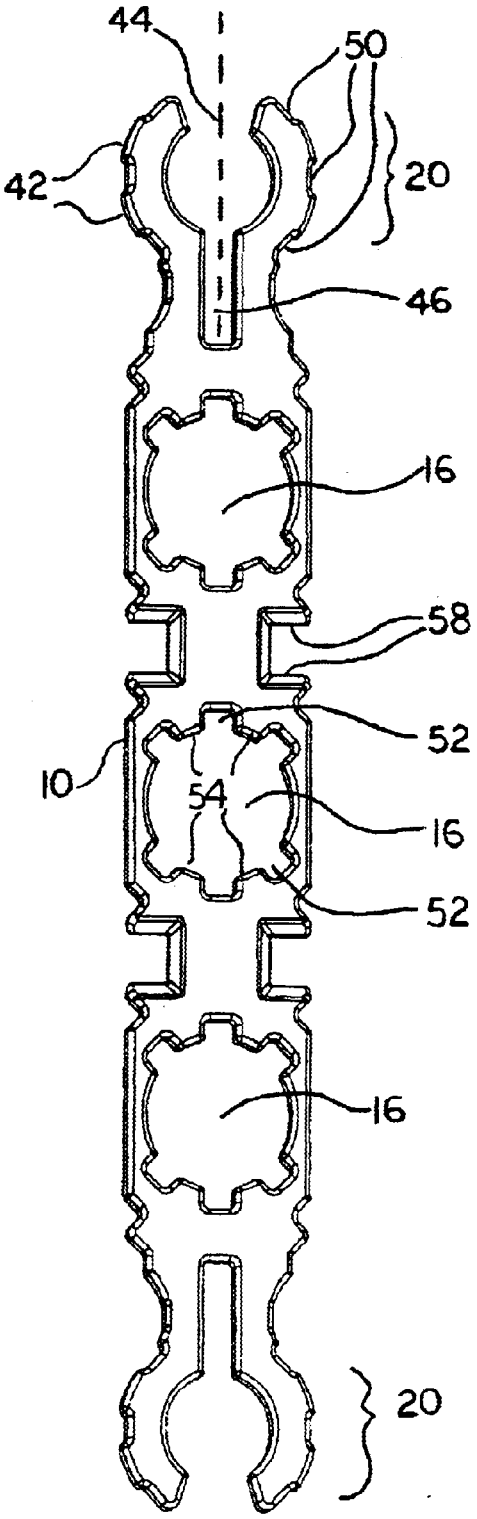
FIG. 2A is a perspective view of a presently preferred embodiment of a planar strut.

FIG. 2A is a top (identical to the bottom) and perspective view of a planar strut 10 of the presently preferred embodiment. There are several features that should be noted. First, the planar strut 10 has the C-claw shape 20 on each end. However, many different types of ends can be provided on the struts 10, 12. Thus, a strut 10, 12 may have a C-claw shape 20 on a first end, and an inverted claw (to be shown later) on the opposite end.

Figure 3:
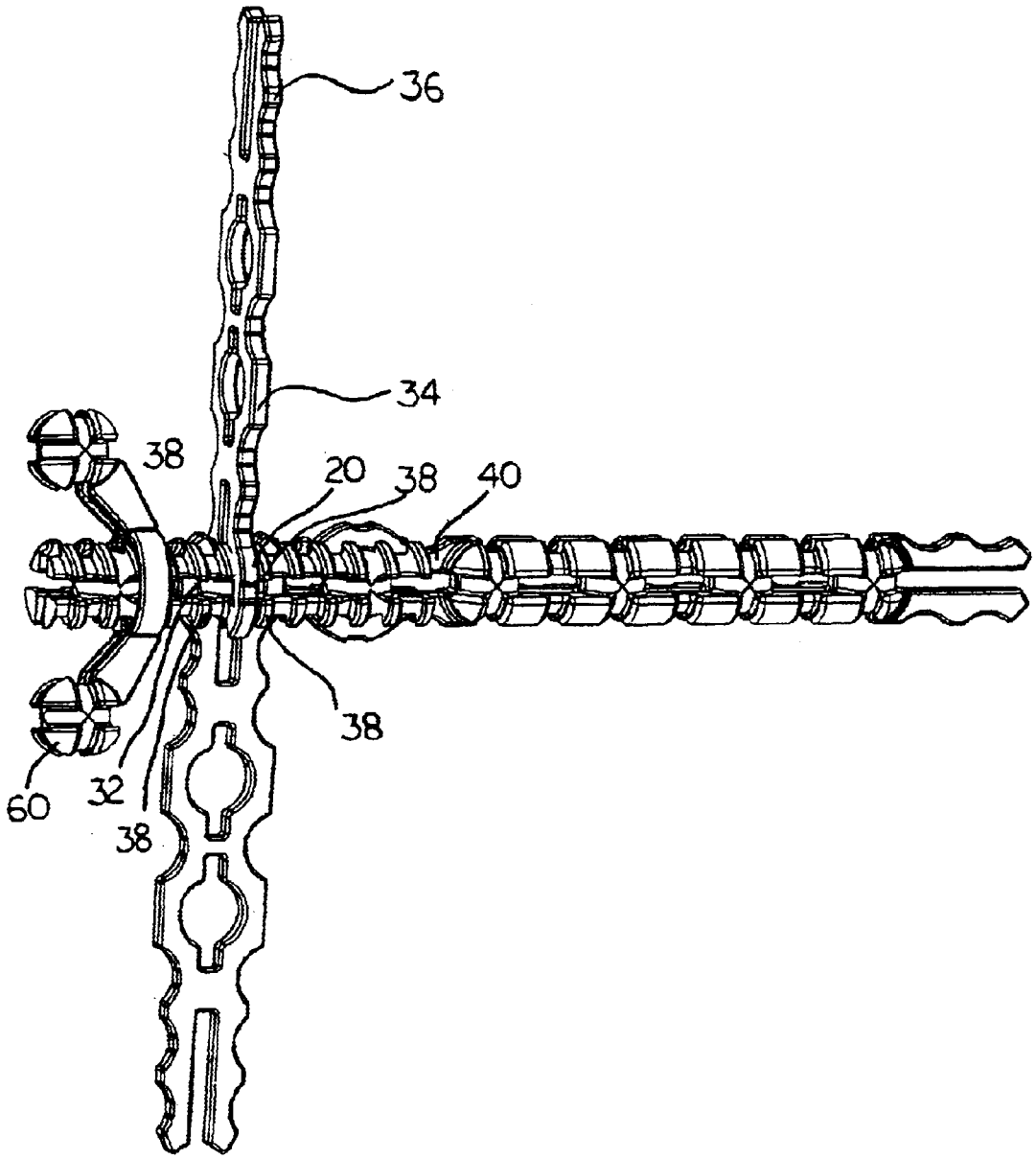
FIG. 3 is a perspective view of a plurality of planar struts, threaded spiral and plain channel cylindrical struts, and a single wing nut construction element.

FIG. 3 is provided to illustrate how the C-claw shape 20 is used to enable the planar strut 10 to attach to other construction elements that include a round or ball-like structure, by surrounding the ball 32. In FIG. 3, a planar strut 34 has a C-claw shape 20 on an attaching end, and an inverted claw 36 on the opposite end. The ball 32 has channels 38 which guide the attaching planar strut 34 into a specific but not necessarily fixed position relative to the ball 32. For example, in this preferred embodiment, the planar strut 34 is free to pivot or rotate around the ball 32 in a plane defined by the channels 38 because there are no interfering struts or other structures to impede movement. If the channels 38 were not present, the C-claw shape 20 would slip off. Thus is it noted that cylindrical struts 40 include various projections that serve as channels on the balls 32.

Returning to FIG. 2A, other features on the planar strut 10 include dentations 42 and indentations 50 at various angles on outer edges of the C-claw shape 20. The indentations 50 in this preferred embodiment are made at 45, 90, and 135 degree angles relatively to a long axis 44 of the planar strut 10. A slot 46 is also shown that extends partway into the planar strut 10. The slot 46 enables the C-claw shape 20 to engage a ball or other appropriate structure even if there is an intervening construction element that lies along the plane of the slot 46.

An example of such a configuration is shown in FIG. 1 at intersection 48. At intersection 48, a planar strut 10 has already engaged a ball structure of the cylindrical strut 12 at an angle of approximately 45 degrees. The planar strut 10 is probably free to pivot about the ball were it not for the cylindrical strut 12.

The C-claw shape 20 of the cylindrical strut 12 is also engaging the ball structure at intersection 48. A slot 46 (not shown) in the attaching end of the cylindrical strut 12 has made it possible for the C-claw shape 20 to move forward far enough to engage the ball structure, as well as engage a portion of the planar strut 10 within the slot 46. Thus, it is a feature of the present invention that more than one strut 10, 12 can be simultaneously engaged at a same location. While there is a physical limit to the number of struts that can be simultaneously engaged because of thicknesses thereof, this feature is quite advantageous, and yields a surprisingly large number of configurations.

FIG. 2A also shows a plurality of apertures 16 along a length of the planar strut 10. There are several features of the apertures 16 that can be varied. For example, it is a feature of the preferred embodiment that planar 10 and cylindrical 12 struts can be made of various lengths, and thus the length of a planar strut is a function of the total number of apertures that are disposed therethrough. This variety in length is necessary in order to create the widest variety of models, shapes, patterns or designs.

A second feature of the apertures 16 are the indentations 52 and the dentations 54 in the sides thereof. These features enable the aperture to perform different functions. For example, the dentations 54 can act as gear teeth. The dentations 54 can also function to keep the strut 10 in a groove or channel formed in other construction elements. The dentations and indentations might even be able to lock the strut 10 into a particular position. However, it is more likely that an end of the strut 10 would engage some other construction element and thereby hold the strut in place. This is precisely the situation in FIG. 1, where intersection 14 shows where dentations on the planar strut 14 are disposed within channels formed on the cylindrical strut 12. The planar strut 10 is then held in place at intersection 18.

FIG. 3 also introduces a new type of construction element that is typically used with threaded spiral cylindrical struts. Specifically, a wing nut 60 type of structure is disposed on an end of the cylindrical strut 40. This wing nut 60 is shown more clearly in FIG. 4.

Figure 4:
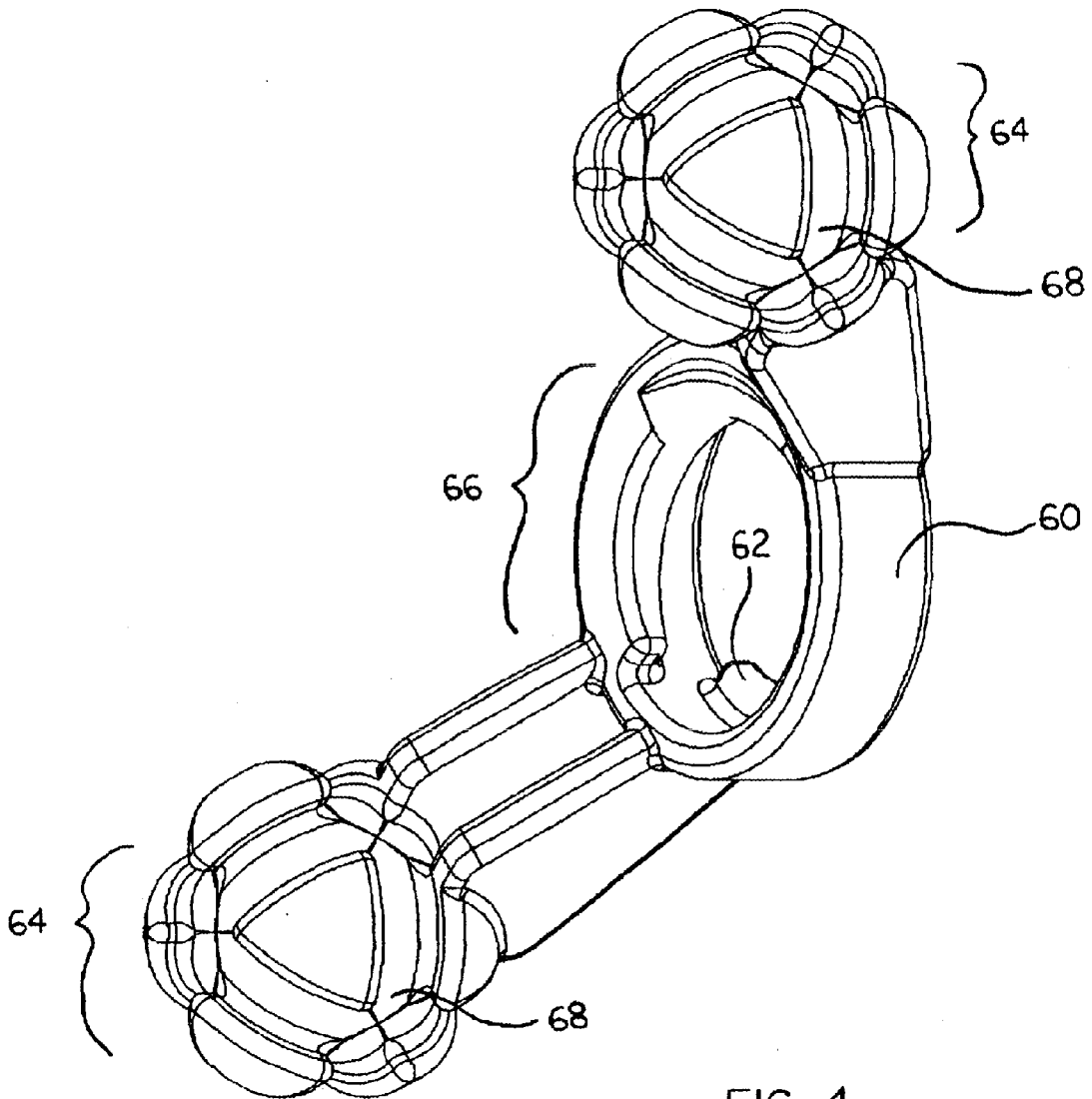
FIG. 4 is a close-up perspective view of the wing nut construction element shown in FIG. 3.

FIG. 4 shows that the wing nut 60 is comprised of a center cylindrical portion 66 that is larger than a cylindrical strut around which it will fit. Two gripping portions or handles 64 are also provided. On the ends of the handles 64 are ball structures that enable other construction elements to be coupled thereto. This means that the wing nut 60 can be held rigidly in place, or be free to rotate.

The wing nut 60 is capable of being advanced along a length of a threaded or helical groove cylindrical strut 40. Advancement is possible because of a helical projection 62 along an inner surface of the wing nut 60. The helical projection 62 engages a complementary channel or groove that is generally disposed along the length of the helical cylindrical strut 40. However, it should be apparent that because the channels disposed on cylindrical struts do not have to be the same, there will be some channel structures that will not enable the wing nut to advance along the length of the cylindrical strut, such as cylindrical strut 12 (FIG. 1).

Figure 5:
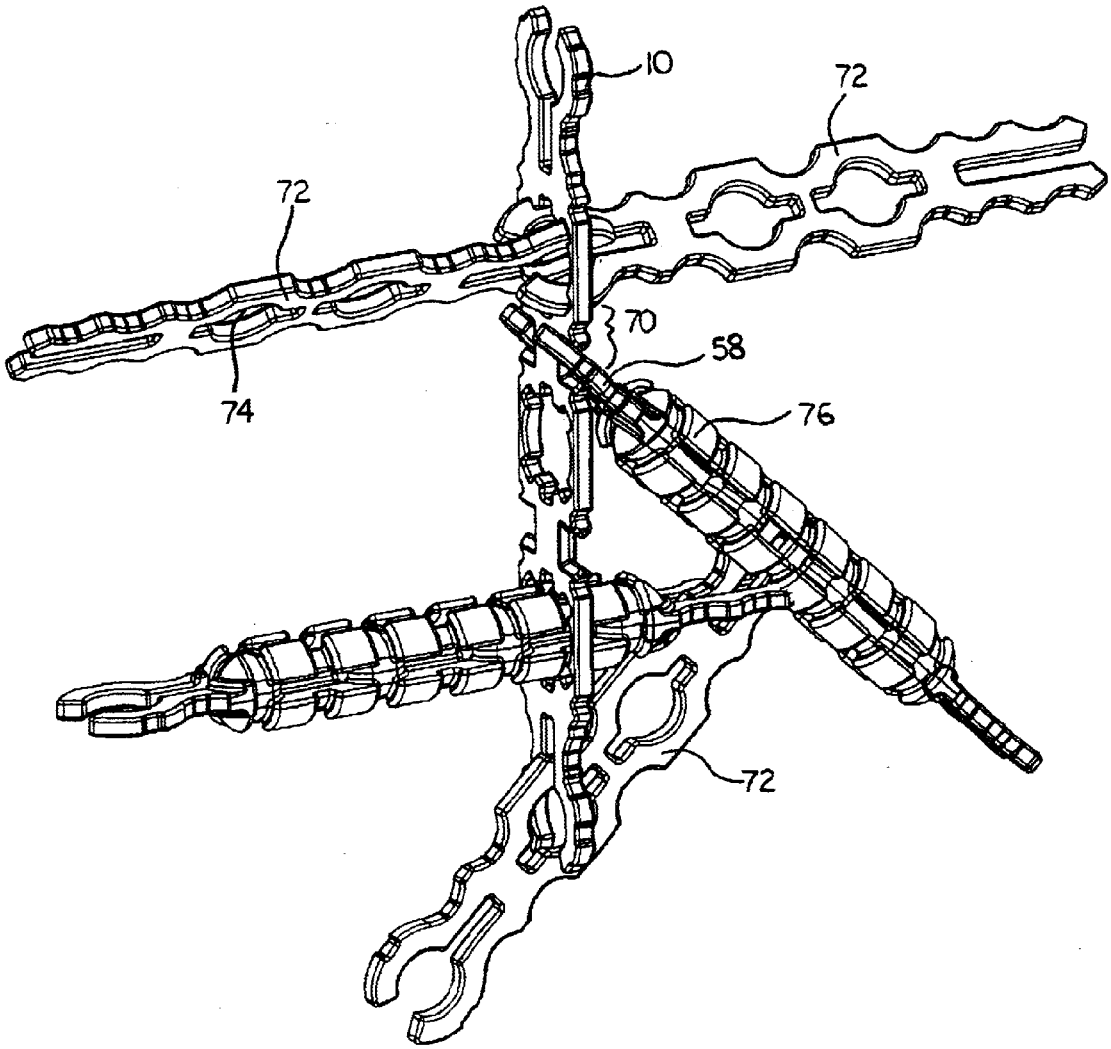
FIG. 5 is a perspective view of planar struts and cylindrical struts that illustrates an advantageous bevel on a planar strut.

Another feature of the planar strut 10 of FIG. 2A is a beveled edge 58. After using prototype struts, it was determined that these beveled edges 58 are necessary in order to enable construction elements to be coupled to the planar strut 10 at particular angles. An example of the connection at an advantageous angle is illustrated in FIG. 5.

Figure 2B:
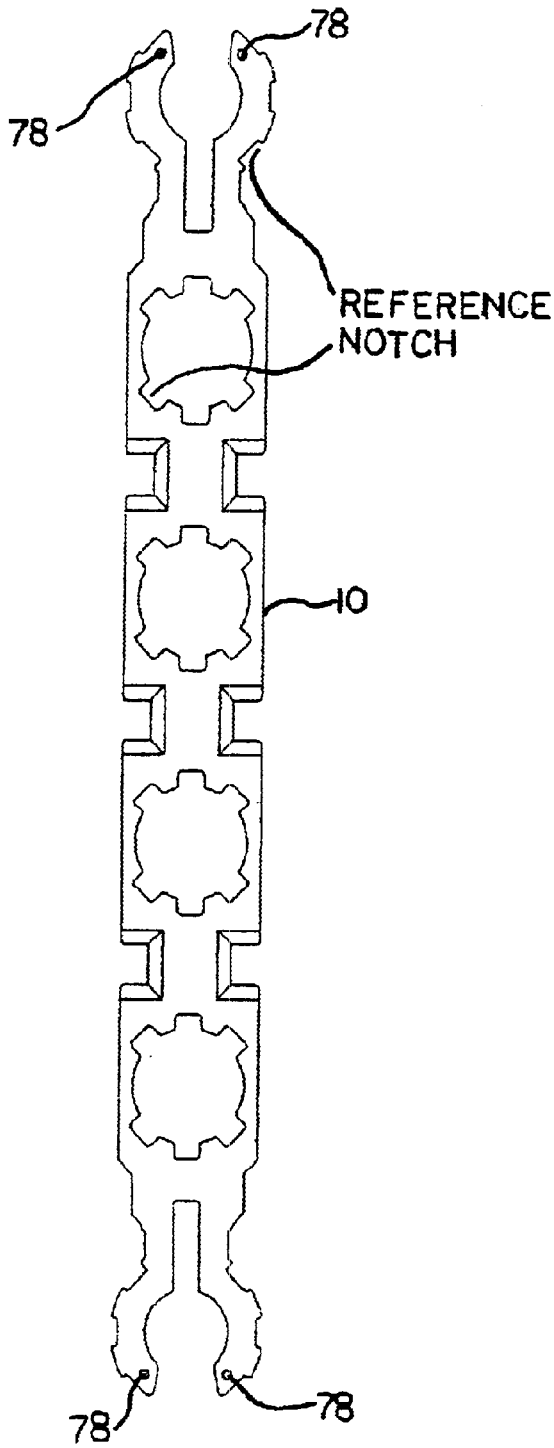
FIG. 2B is a top elevational view of a slightly altered version of the planar strut of FIG. 2A.

FIG. 2B is provided to show a top view of a slightly different planar than is shown in FIG. 2A. One particular feature that is not visible in the drawings of the planar struts 10 shown in FIGS. 1 and 2A is at least one hole 78 that extends from one side of the planar surfaces to the other. The function of the hole is to enable a material such as a fiber or string to be passed therethrough. The fiber could be something like a nylon fishing wire.

The purpose of providing the ability to pass a fiber through the holes 78 is simply to enable, for example, the movement of the fiber. The fiber could be part of a crane or lever arm. The fiber could be actuated by a servo-mechanism that would apply a force to some other construction element. Accordingly, the position of the holes 78 as shown in FIG. 2B could be changed, or more could be added to increase versatility of the planar strut 10, without compromising strength of the planar strut 10.

FIG. 2B is also different from FIG. 2A in that two dentations 54 are removed from the apertures 16. This enables the apertures 16 to be capable of connecting to a turtle hole.

FIG. 5 is provided to show a plurality of different types of planar struts. The planar strut 10 is the same strut that was the preferred embodiment of FIGS. 2A and 2B. Planar struts 72 are an alternative embodiment that differ in that they include different ends, but more importantly, they have differently shaped apertures 74.

Intersection 70 shows the cylindrical strut 76 coupled to planar strut 10. The beveled edge 58 enables the cylindrical strut 76 to make a 45 degree angle with respect to the length of the planar strut 10. In effect, the cylindrical strut 76 is able to lie flush against the beveled edge 58.

Figure 6:
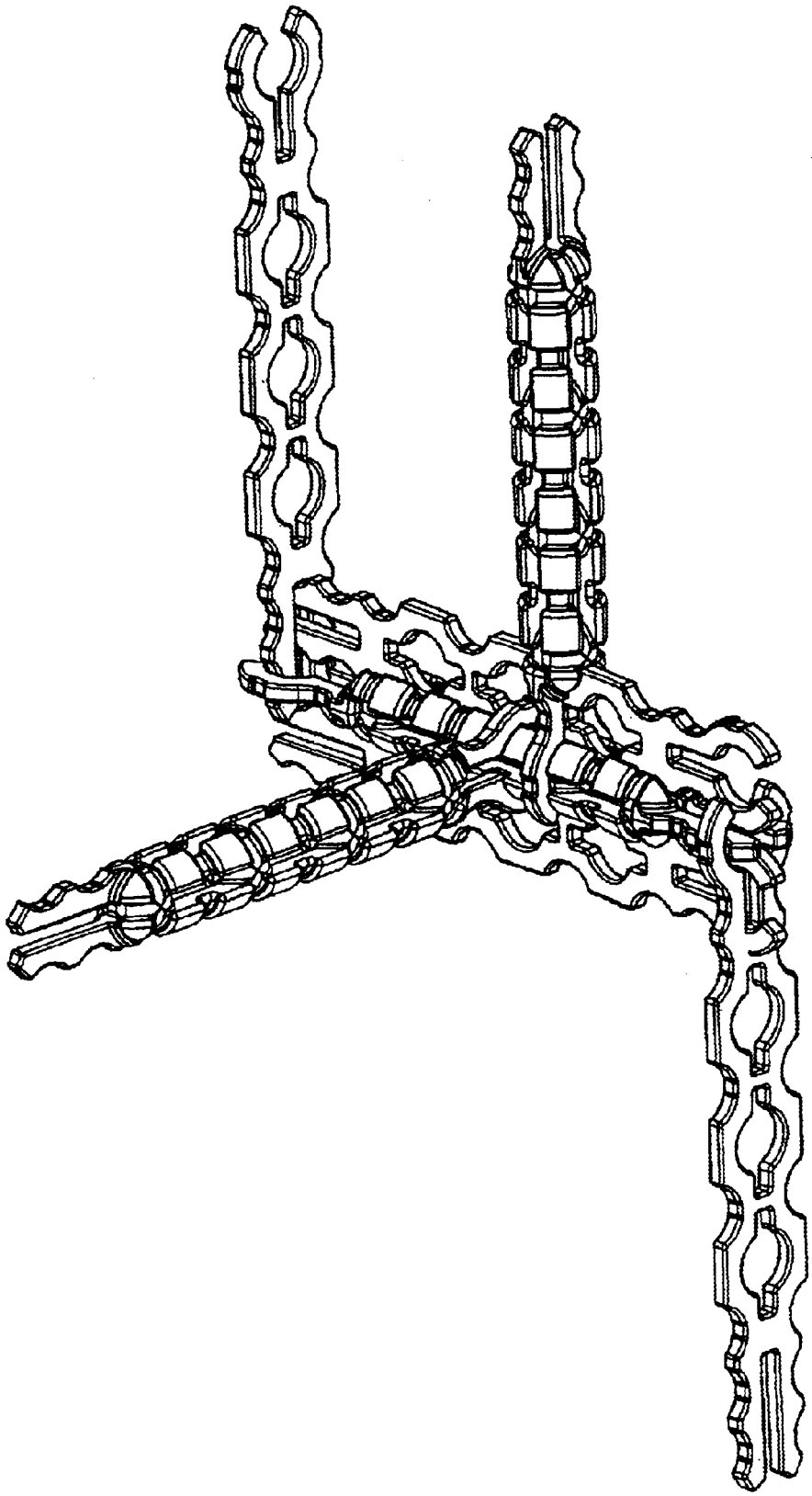
FIG. 6 is a perspective view of a plurality of planar struts and cylindrical struts disposed in close proximity to each other.
Figure 7:
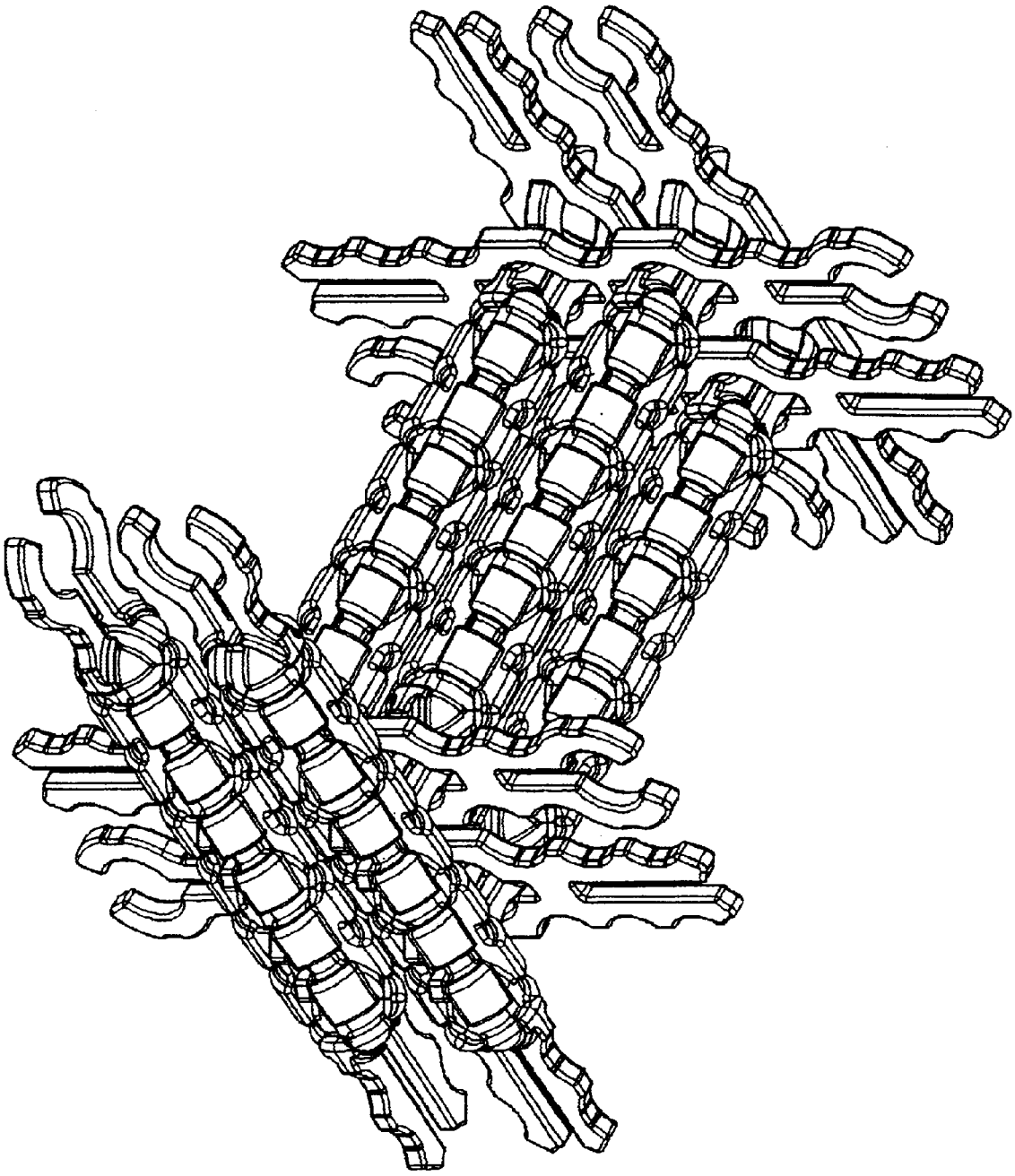
FIG. 7 is a perspective view of a plurality of more planar struts and cylindrical struts disposed in close proximity to each other.

FIGS. 6 and 7 are provided in order to illustrate the concept that the planar and cylindrical struts 10, 12 can not only be coupled in many ways, but can also be coupled very closely together. In other words, the struts 10, 12 can be disposed directly adjacent to each other.

Figure 8A:
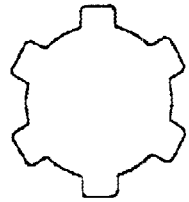
FIG. 8A is a top elevational view of a possible configuration for an aperture disposed through a planar strut.
Figure 8B:
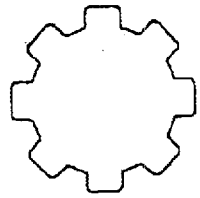
FIG. 8B is a top elevational view of a possible configuration for an aperture disposed through a planar strut.
Figure 8C:
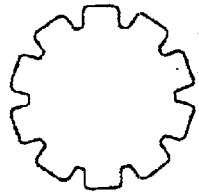
FIG. 8C is a top elevational view of a possible configuration for an aperture disposed through a planar strut.
Figure 8D:
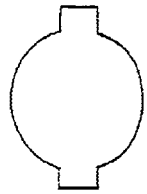
FIG. 8D is a top elevational view of a possible configuration for an aperture disposed through a planar strut.

FIGS. 8A, 8B, and 8C are provided to illustrate several different possible configurations of dentations and indentations that can be disposed within apertures. A single planar strut might even include several of these configurations simultaneously. Such a feature would increase versatility of a single planar strut.

Figure 9:
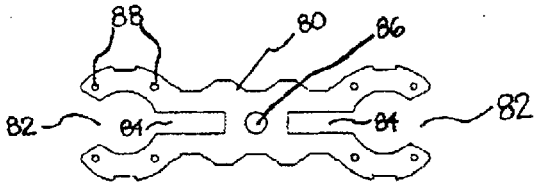
FIG. 9 is a top elevational view of a planar strut having a length that is different than previously seen planar struts.

FIG. 9 is a top elevational view of a planar strut 80 that does not have any large aperture in it. A C-claw 82 is disposed at each end, as well as a slot 84. A middle portion of the planar strut 80 now comprises a hole 86 that is relatively larger than the smaller holes 88. Finally, various dentations and indentations form the outline of the planar strut 80.

Figure 10:
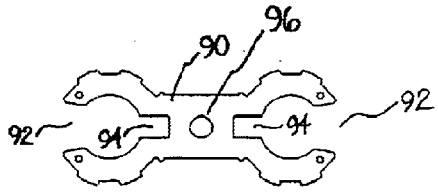
FIG. 10 is a top elevational view of a planar strut having a length that is different than previously seen planar struts.

FIG. 10 is a top elevational view of a slightly smaller and modified planar strut 90 as compared to the planar strut 80 of FIG. 9. While it includes a C-claw 92 at each end, a length of the planar strut 90 is reduced, slots 94 are shorter, and the indentations and dentations that form the outline are different. However, a hole 96 is still disposed through the center of the planar strut 90. The various spacing differences for connection points of the struts of FIGS. 9 through 17 are provided for different purposes, such as some struts functioning as diagonal construction elements, and others as horizontal and vertical construction elements.

Figure 11:
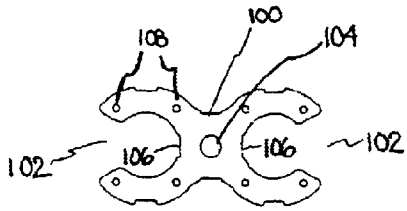
FIG. 11 is a top elevational view of a planar strut having a length that is different than previously seen planar struts.

FIG. 11 is a top elevational view of an even shorter planar strut 100 as compared to the planar strut 90 of FIG. 10. Slots are replaced with an indentation 106, but a center hole 104 is still present. The placement and number of smaller holes 108 is also shown to be different from the number and placement of smaller holes in FIG. 10.

Figure 12:
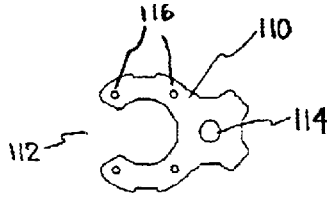
FIG. 12 is a top elevational view of a planar strut having a length that is different than previously seen planar struts.

FIG. 12 is a top view of the smallest planar strut 110 that is contemplated. The planar strut 110 has a single C-claw 112 on one end, a larger hole 114, and several smaller holes 116.

Figure 13:
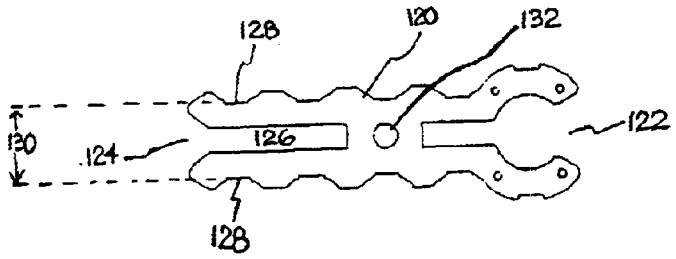
FIG. 13 is a top elevational view of a planar strut that includes a C-claw and an inverted claw attaching end.

In FIG. 13, a larger planar strut 120 is provided with a C-claw 122 on one end, and an attachment mechanism that is referred to as an inverted claw 124 on an opposite end. The inverted claw 124 has attaching arms that are curved outward instead of inwards like the C-claw shape. A slot 126 enables the attaching arms to bend inwards as they slip into another construction element. The nature of the construction elements is relatively elastic because they are made of a plastic material. Thus, after slightly deforming so as to slip into an opening or gap that is slightly narrower than a widest width of the attaching arms, the attaching arms will try and resume an at-rest shape. This will generally be possible because the width of the gap will generally be the same as or slightly smaller than the width between indentations 128, and indicated as width 130 on FIG. 13. The planar strut 120 also includes hole 132.

Figure 14:
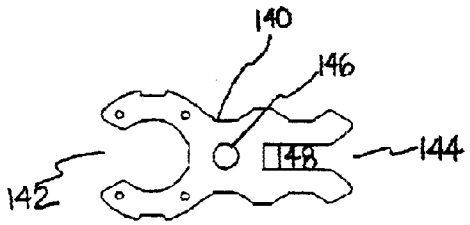
FIG. 14 is another top elevational view of a planar strut that includes a C-claw and an inverted claw attaching end.

FIG. 14 is a top elevational view of a planar strut 140 that has a C-claw 142 and an inverted claw 144 on ends thereof, and hole 146 in a center. A slot 148 is significantly shorter than the slot 126 of FIG. 13.

Figure 15:
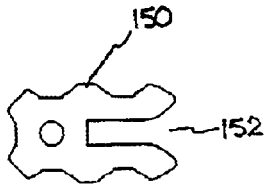
FIG. 15 is a top elevational view of a planar strut that has a single inverted claw attaching end.

FIG. 15 is a top elevational view of a planar strut 150 that is similar to the planar strut 112 in FIG. 12, except that the C-claw is replaced with an inverted claw 152.

Figure 16:
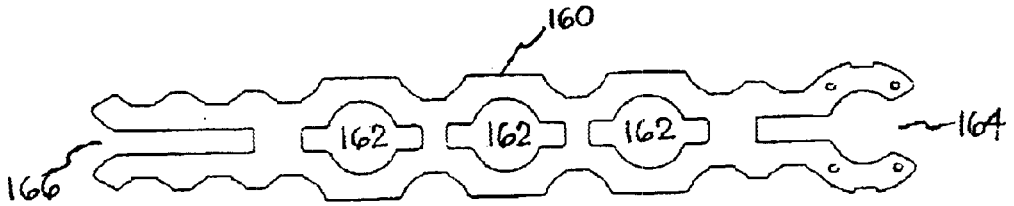
FIG. 16 is a top elevational view of a planar strut that has a different configuration for an aperture disposed therethrough.

FIG. 16 is a top elevational view of a planar strut 160 that illustrates a plurality of apertures 162 that are disposed along a length of the planar strut, and having a C-claw 164 and an inverted claw 166 at opposite ends thereof.

Figure 17:
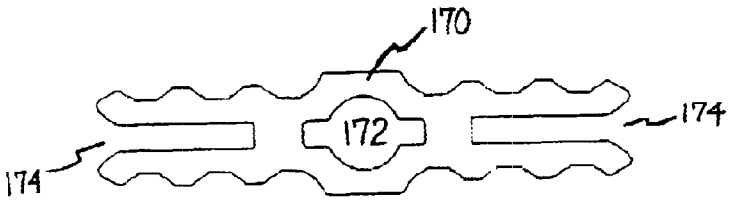
FIG. 17 is a top elevational view of an alternative embodiment of a planar strut.

FIG. 17 is a top elevational view of a planar strut 170 that includes a single aperture 172, and has an inverted claw 174 at each end thereof.

The great variety of planar struts that can be made in accordance with the principles of the presently preferred embodiment are not all shown in FIGS. 1 through 17. However, the particular planar struts that are shown demonstrate many of the principles behind their construction. These principles include the different ends that can be used, the number and shape of apertures, and the various lengths of the planar struts.

With this in mind, it is useful to understand the principle upon which the lengths of the planar struts are based. Essentially, any convenient spacing can be used, as long as the spacing enables construction elements to be coupled together at desired angles. For example, it is obvious that the planar struts can be used to form 90 degree angles. In addition, they must also be capable of forming and attaching together at 45 degree and 135 degree angles. Furthermore, the nature of the channels on cylindrical struts does not preclude that other angles are not possible.

For example, it is possible to form 30 degree, 60 degree, 120 degree and 150 degree angles, depending upon the placement of the channels. An example of two planar struts 10 and a cylindrical strut 12 forming an equilateral triangle, and thus joining at 60 degree angles, is shown in FIG. 1. The struts 10, 12 are joined together at intersections 14, 18, and 24.

In order to be able to form these angles, it is not only necessary that channels be formed at specific angles, it is also necessary that the apertures be positioned correctly, and/or the ends of the struts meet correctly. For these reasons, the present invention contemplates a plurality of different lengths between apertures, and thus the overall length of the planar struts will vary.

The presently preferred embodiment utilizes a system whereby there is a connection point every 5/16 of an inch. It is also a feature of the presently preferred embodiments of the planar struts 10 to be a standard thickness, and a half-standard thickness. Presently, the standard thickness is 0.104", and the half-standard thickness is 0.052". It should be apparent that these values can change as desired.

Figure 18:
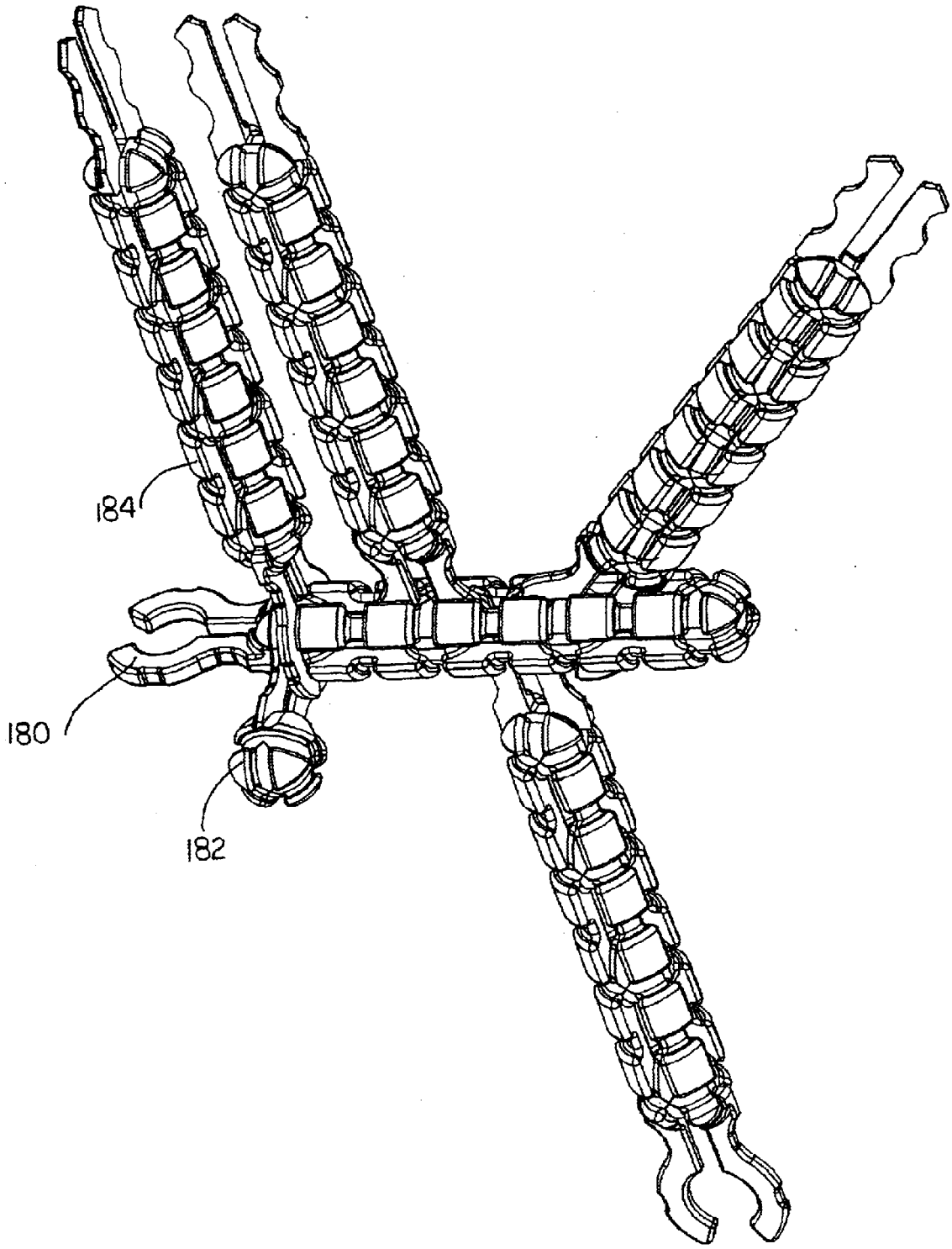
FIG. 18 is a perspective view of cylindrical struts that shows that attaching ends can be manufactured thinner to thereby enable at least two attaching ends to be coupled to a same location on a construction element.

The half-standard thickness mentioned above is present because of a feature that has not yet been illustrated. FIG. 18 is a perspective view of various cylindrical struts coupled together. Notice that cylindrical strut 180 has cylindrical struts 182 and 184 both coupled to a same channel of cylindrical strut 180. In order to do this, the channel is not wider than normal. Instead, both cylindrical and planar struts can have attaching ends that are half-standard thicknesses. This enables any combination of two struts to be coupled to a same channel around a ball of a cylindrical strut as shown. Obviously, wherever a single attaching end of a strut can connect, then two struts with attaching ends that are half as thick can also be disposed, provided that there are no other intervening structures.

Having provided detailed descriptions of planar struts and their preferred dimensions, the next construction element to be described is the cylindrical strut. Cylindrical struts are also provided in many different shapes and sizes.

Figure 19A:
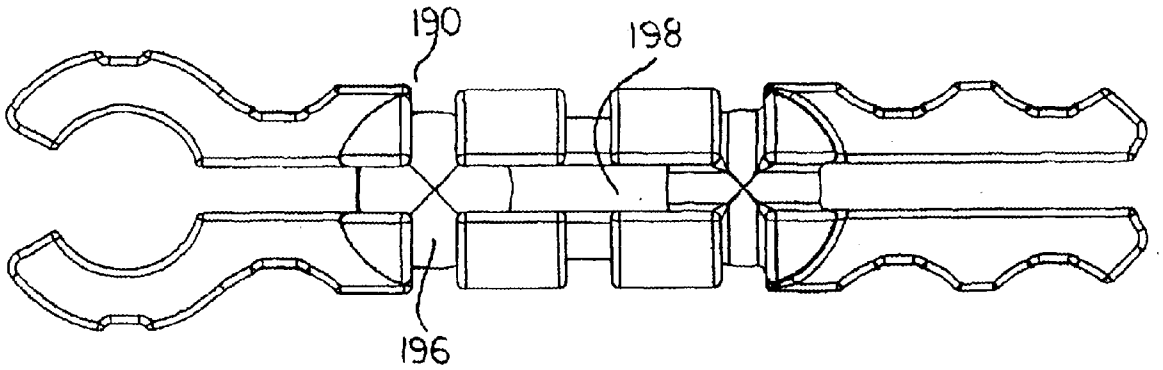
FIG. 19A is a perspective view of a cylindrical strut that is made in accordance with the principles of the presently preferred embodiment.
Figure 19B:
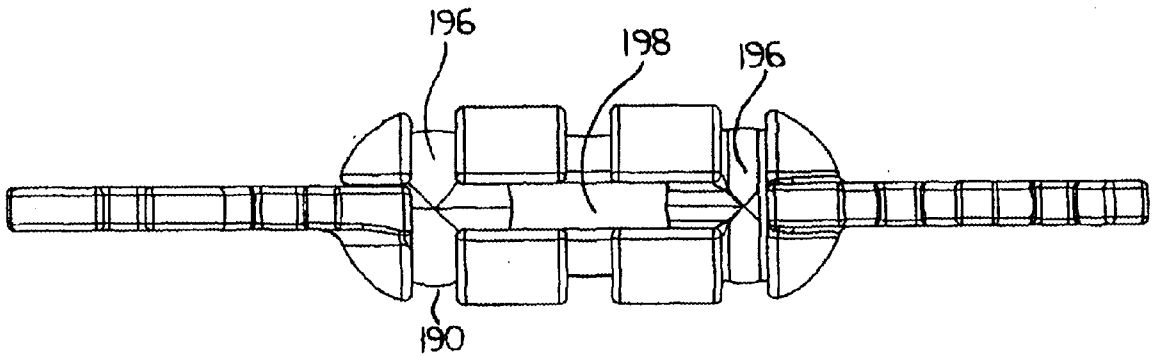
FIG. 19B is a perspective view of the cylindrical strut of FIG. 19A, but rotated 90 degrees.

FIG. 19A is a first perspective view of a typical cylindrical strut 190 of the preferred embodiment. FIG. 19B is a second perspective view of the cylindrical strut 190 that has been rotated along its long axis by 90 degrees. These figures show tow different types of attaching ends, a C-claw 192 and an inverted claw 194. The important difference between a planar strut and the pictured cylindrical strut 190 is the three dimensional nature thereof. This only means, for example, that because a ball structure 196 is used to form the shaft of the cylindrical strut 190, another construction element can be coupled to the ball structure 196 from any angle along a channel.

Nevertheless, there are gaps 198 between the ball structures 196. If a C-claw is inserted around a ball structure 196, an attaching arm partially fills the gaps on either side of the ball structure. In contrast, the spacing of the gaps 198 is just sufficiently wide to enable an inverted claw to be inserted therein. As previously explained, the attaching arms will be slightly deformed as they are pushed inwards by the ball structure 196 on either side. But after passing the ball structures 196, the attaching arms will return to their normal at-rest width, and the cylindrical strut will be held in place in a relatively rigid manner.

Figure 20:
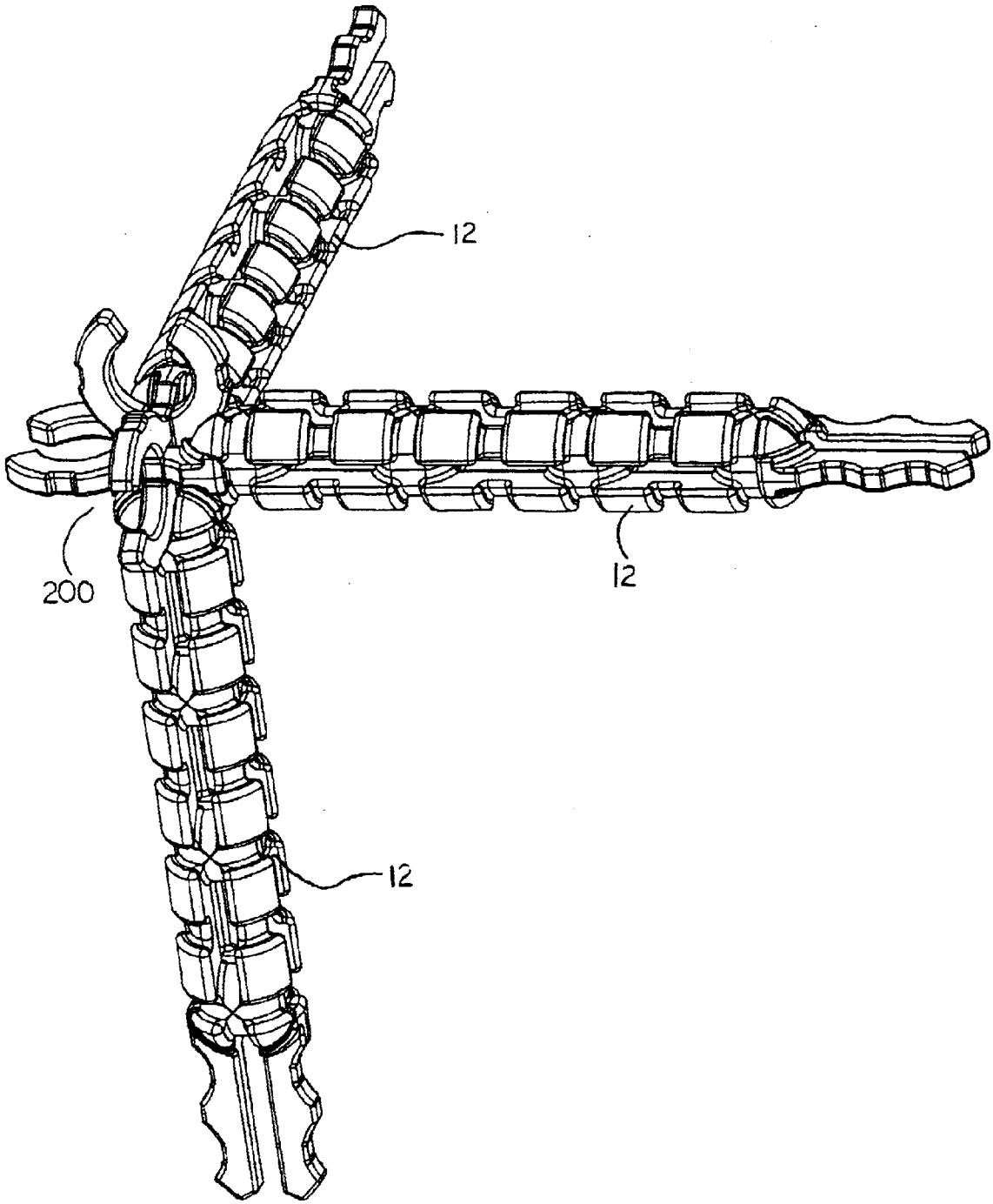
FIG. 20 is a perspective view of three cylindrical struts that are coupled together at one intersection using a slot disposed adjacent to C-claw attachment ends.

FIG. 20 is a perspective view of three cylindrical struts 12. It was explained previously that it is possible to dispose a plurality of different construction elements at a same location. This figure illustrates how three cylindrical struts 12 can be coupled together at an intersection 200, where the C-claw attaching ends do not interfere with each other. The connection point is actually a slot disposed adjacent to the C-claw attachment ends.

Figure 21:
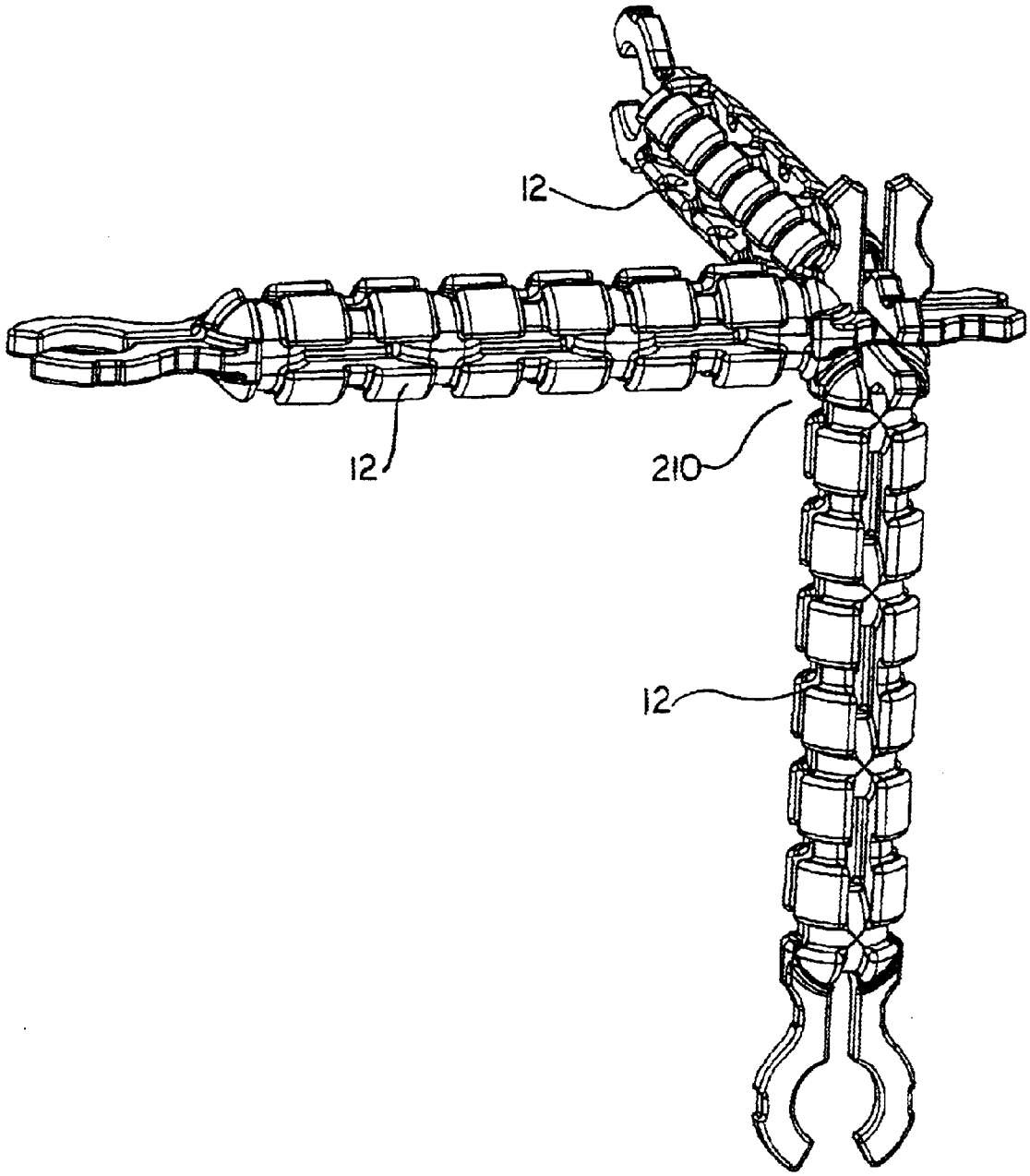
FIG. 21 is a perspective view of three cylindrical struts that are coupled together at one intersection using a slot disposed adjacent to inverted claw attachment ends.

FIG. 21 is also a perspective view of three cylindrical struts 12. However, what is different is that instead of the C-claw attaching end, a slot disposed adjacent to the inverted claw attaching ends makes the connection possible at intersection 210.

Figure 22:
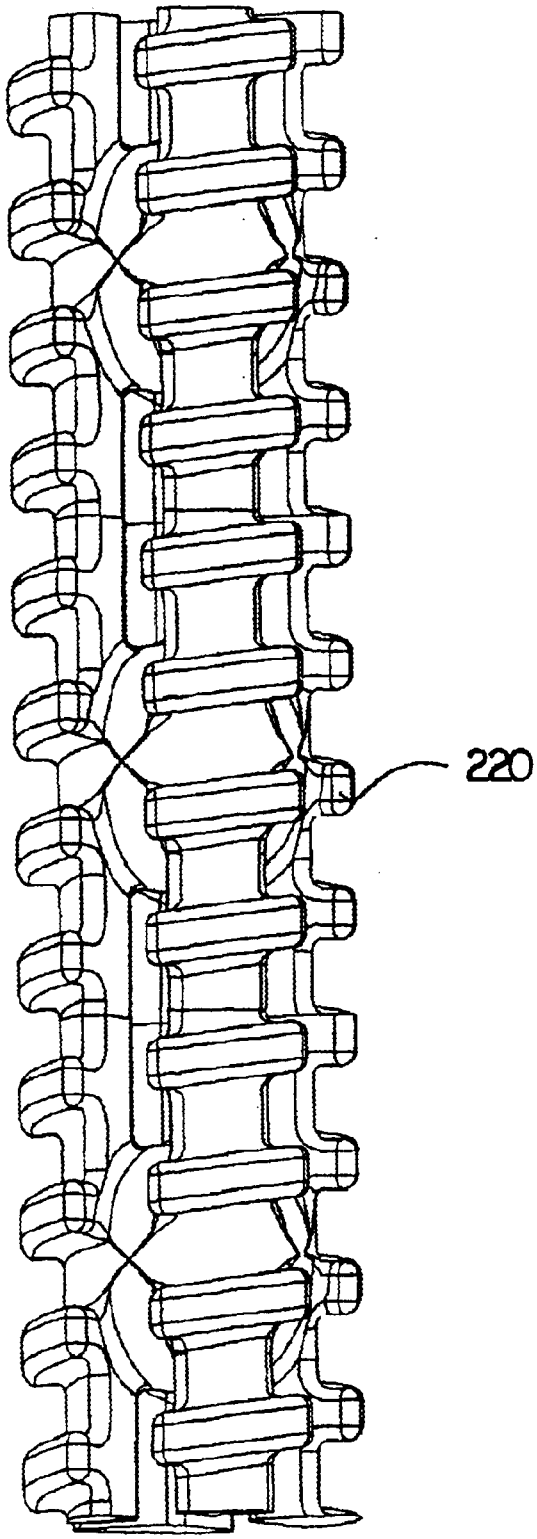
FIG. 22 is a perspective view of an alternative embodiment of a cylindrical strut having a helical or threaded channel or groove design.

An observation that should be made is that while all of the planar and cylindrical struts have included attaching ends, this is not necessary. In other words, the planar and cylindrical struts can end without any type of attaching end disposed thereon. For example, consider the cylindrical strut 220 shown in FIG. 22. This cylindrical strut 220 still has many attachment points for coupling to other construction elements.

Figure 23:
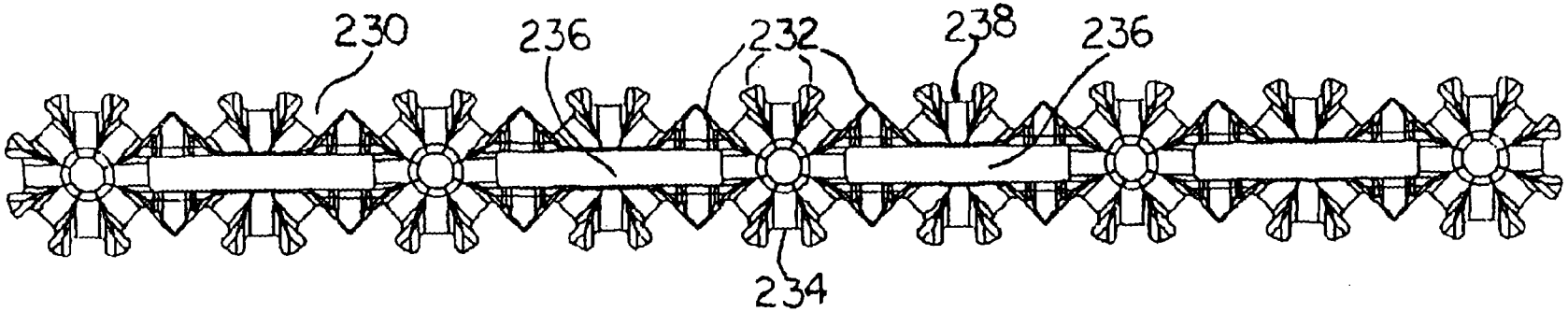
FIG. 23 is a perspective view of an alternative embodiment of a cylindrical strut.

Just as planar struts can vary, for example, in the shape of apertures along the length thereof, in the number of apertures, and the types of attaching ends disposed thereon, cylindrical struts can have many variations. FIG. 23 is provided as a perspective view of an alternative embodiment of a cylindrical strut 230. In this embodiment, the cylindrical strut 230 has a plurality of channels 232 disposed on the ball structures 234. In fact, some of the ball structures 238 have a channel cut through them to form the gaps 236. Whereas the channels provided on the ball structures of FIGS. 19A and 19B are disposed at 90 degree angles with respect to a long axis of the cylindrical strut 190, the channels 232 are disposed such that a construction element might be coupled to the cylindrical strut 230 at an angle of 45, 90 or 135 degrees with respect to a specific portion thereof.

Figure 24:
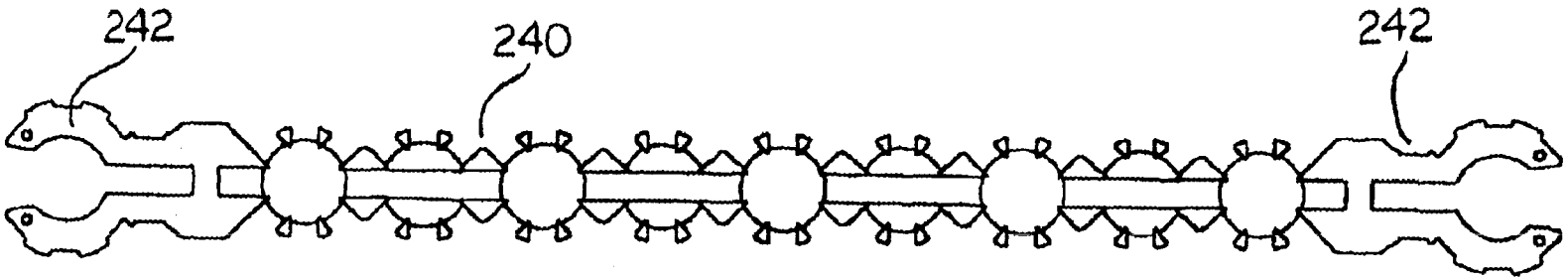
FIG. 24 is a top view of an alternative embodiment of a cylindrical strut.

FIG. 24 is provided as an alternative embodiment of the cylindrical strut 230 of FIG. 23. Specifically, in this top elevational view, the cylindrical strut 240 is constructed in a similar manner as the FIG. 23, but with the addition of C-claw attaching ends 242 disposed at either end. It should be apparent that one or both of the C-claw attaching ends can be replaced by an inverted claw.

Figure 25:
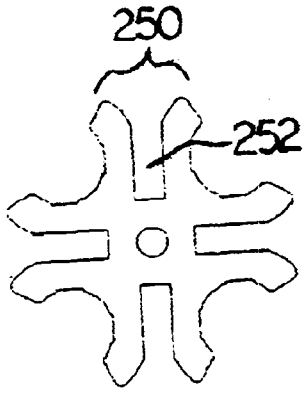
FIG. 25 is a top view of an attaching member having four inverted claw attachment points.
Figure 26:
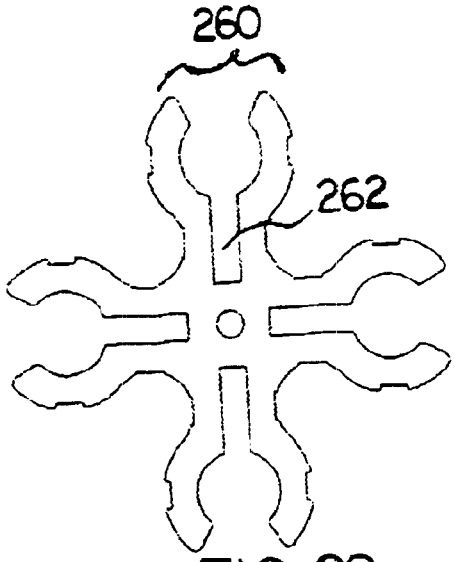
FIG. 26 is a top view of an alternative embodiment of an attaching member having four C-claw attachment points.
Figure 27:
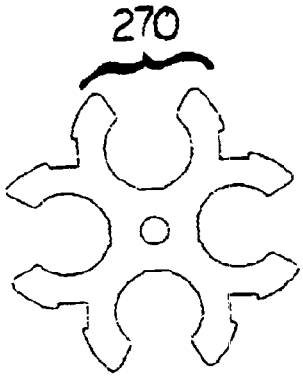
FIG. 27 is a top view of an alternative embodiment of an attaching member having four C-claw attachment points.
Figure 28:
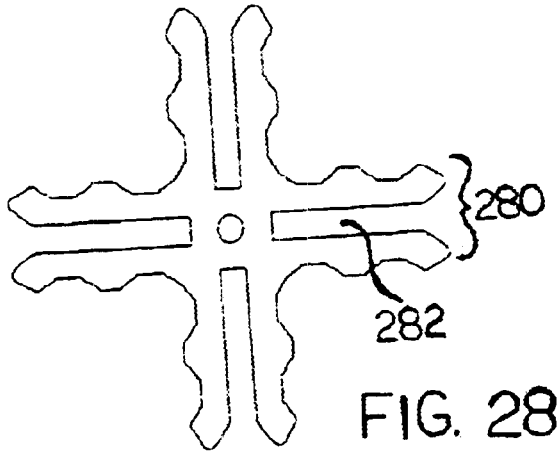
FIG. 28 is a top view of an alternative embodiment of an attaching member having four inverted claw attachment points.
Figure 29:
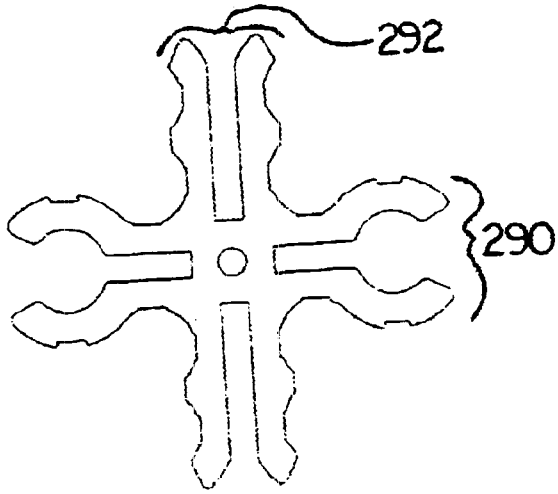
FIG. 29 is a top view of an alternative embodiment of an attaching member having two inverted claw and two C-claw attachment points.

Even with the amazing diversity that is possible in the design of the cylindrical and planar struts of the present invention, there are other construction elements that require descriptions. FIGS. 25, 26, 27, 28 and 29 are top elevational views of rather useful construction elements. These construction elements are four-way couplers. FIG. 25 has four inverted claws 250, and relatively short slots 252. FIG. 26 has four C-claws 260 with slots 262 of approximately the same length. FIG. 27 is a more compact version of the four C-claws 260 of FIG. 26. However, the C-claws 270 of FIG. 27 have no slots. FIG. 28 has four inverted claws 280, but with relatively long slots 282 as compared to the slots 252 of FIG. 25. FIG. 29 is a combination of the four-way couplers of FIG. 26 and FIG. 28. Specifically, the four-way coupler includes two C-claws 290 and two inverted claws 292.

Figure 30:
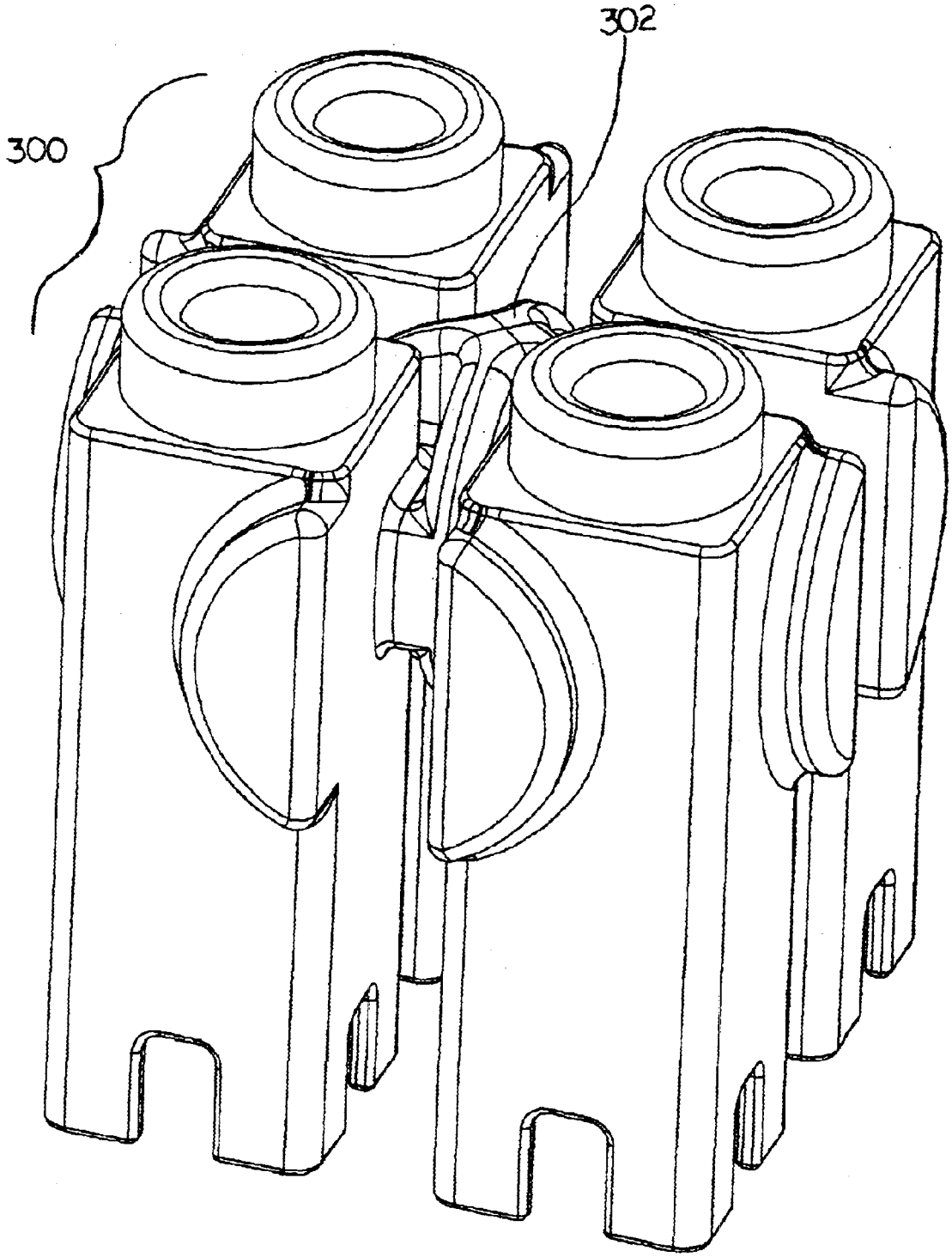
FIG. 30 is a perspective view of a brick construction element having a central ball.

FIG. 30 is a close-up perspective view of a block 300 that is capable not only of being coupled to other blocks, but to the planar and cylindrical struts. This configuration is made possible because of the ball structure 302 in the center of the block 300.

Figure 31:
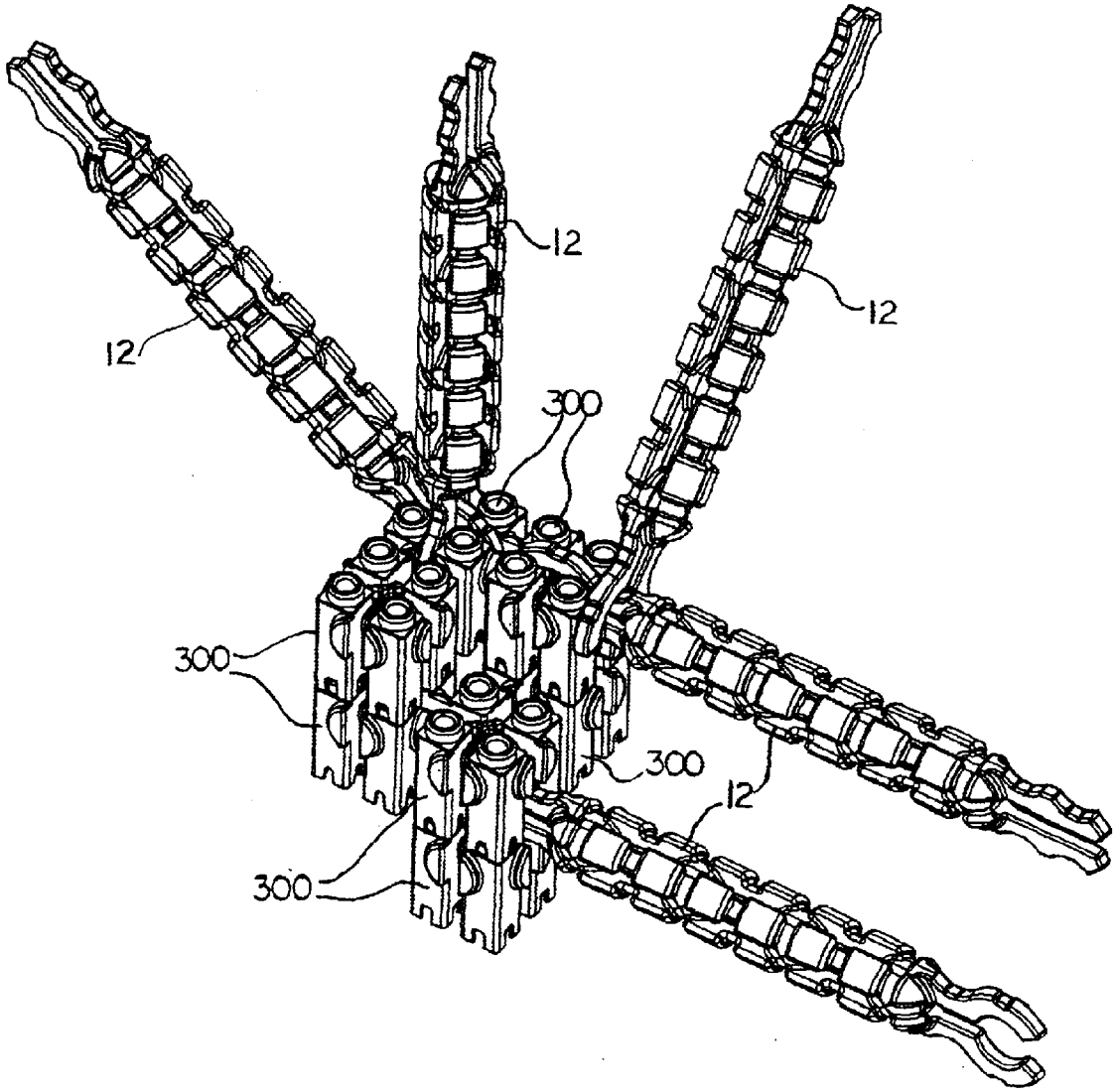
FIG. 31 is a perspective view of the brick construction element coupled together with cylindrical struts.

FIG. 31 is provided to illustrate how some blocks 300 have been coupled together, and coupled to some cylindrical struts 12. As shown, the block 300 is a versatile construction element that is easily used to build models, shapes, patterns or designs with the planar and cylindrical struts. The spacing for connectable points is the same for the blocks 300 as the struts, thus making it easy to integrate the blocks 300 into structures that are comprised mainly of struts.

Figure 32:
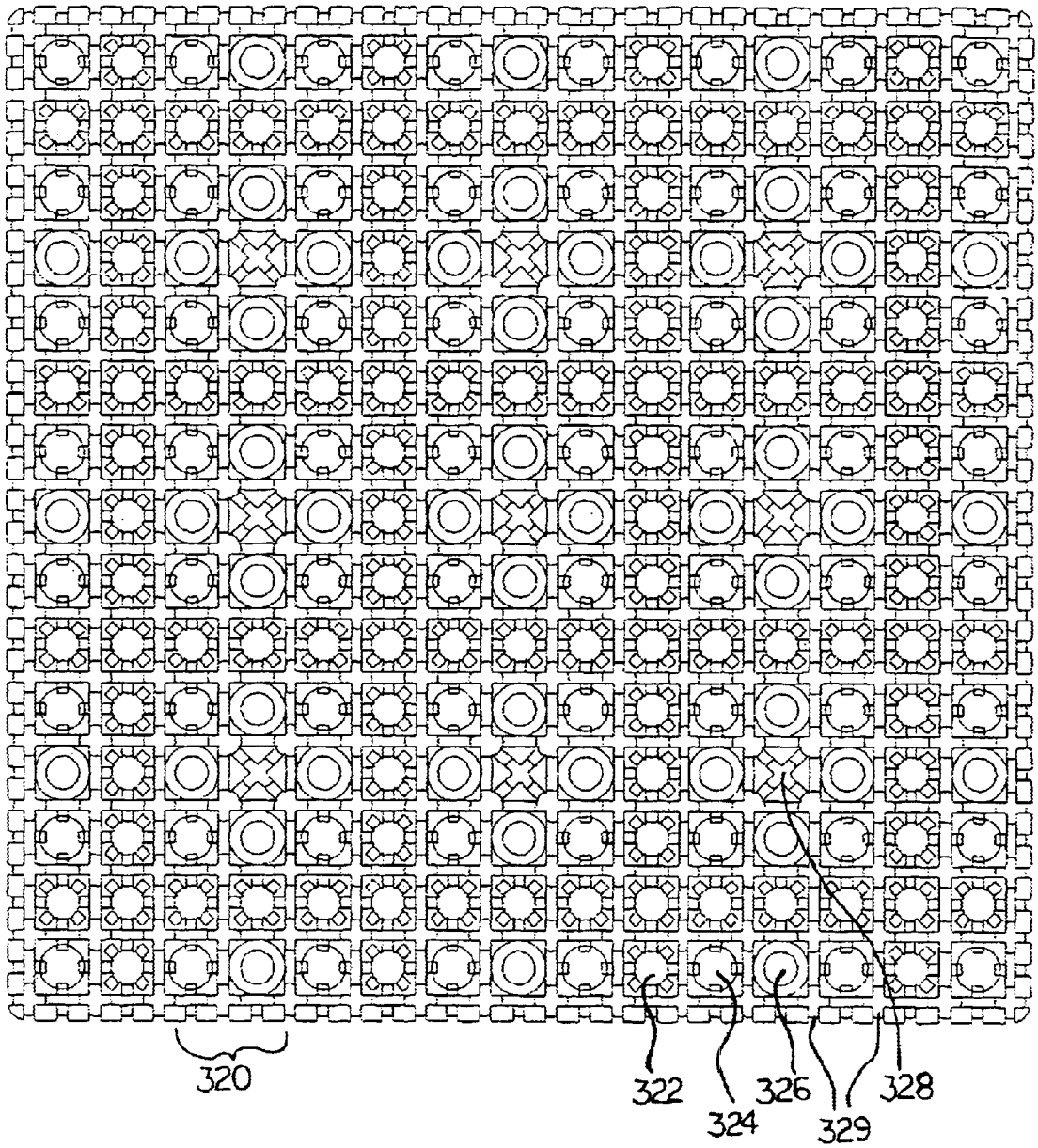
FIG. 32 is a top view of a base platform which is comprised of a plurality of different types of attaching construction elements.

FIG. 32 is provided to illustrate in a top elevational view a base or platform grid 320 for construction elements. The purpose of the platform grid 320 is to provide a surface that can connect to many different types of construction elements. In this figure, there are four different types of connecting elements, 322, 324, 326 and 328. These different connecting elements are capable of connecting to ball structures and inverted claws. Obviously, the types of connecting elements can be varied. In other words, a connecting element can be provided with a ball structure that enables a C-claw to be coupled thereto. Another useful connecting element would be one which is connectable to a block as shown in FIGS. 30 and 31. What is important is to understand that a wide variety of different connecting elements can be disposed on a platform grid to make a convenient beginning point for the models, shapes, patterns or designs that can be built, such as providing walls, floors or ceiling structures.

In order to understand how the connecting elements 322, 324, 326, 328, and 329 provide connecting points, the first three will be shown in profile to show how they connect to an inverted claw or ball structure. Beginning with FIG. 33B, a top view of connecting element 326 is shown. A cut-away profile view of connecting element 326 is shown in FIG. 33A. Finally, a cylindrical strut 330 is shown having an inverted claw coupled to connecting element 326 in FIG. 33C.

FIG. 34B shows a top view of connecting element 324. A cut-away profile view of connecting element 324 is shown in FIG. 34A. Finally, a cylindrical strut 340 is shown having a ball structure coupled to connecting element 324 in FIG. 34C.

FIG. 35B shows a top view of connecting element 322. A cut-away profile view of connecting element 322 is shown in FIG. 35A. A cylindrical strut 350 is shown having an inverted claw coupled to connecting element 322 in FIG. 35C.

There are obviously many ball structures 328 and 329 disposed within the platform grid 320. These ball structures 328 are located at the corner of each connecting element 322, 324 and 326, and at the center of connecting element 329. A final observation concerning the grid connection elements 322, 324 and 326 is that they enable simultaneous access from opposite sides.

Figure 36:
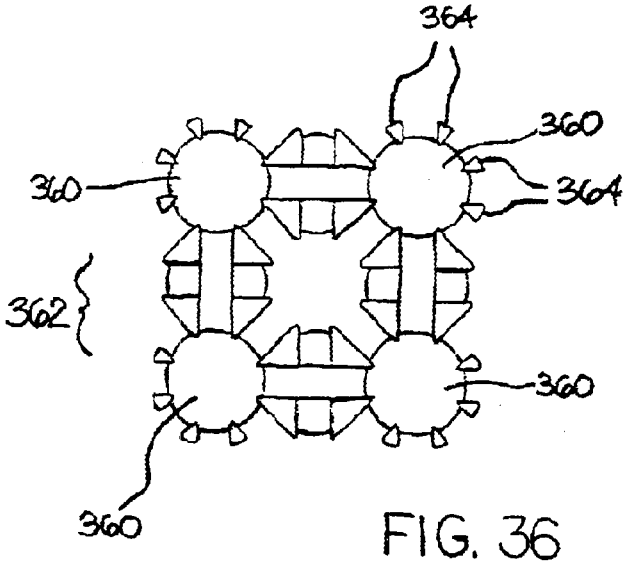
FIG. 36 is a top view of a square grid connection element.

FIG. 36 is provided to illustrate another type of construction element. In this top elevational view, ball structures 360 are disposed in each corner of a three dimensional 3×3 square grid connection element 362. The ball structures 360 have channels 364 disposed thereon that enable a C-claw to be coupled thereto at various angles with respect to the square grid connection element 362.

Figure 37:
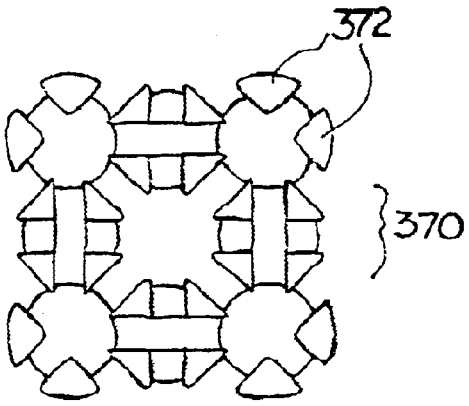
FIG. 37 is a top view of an alternative embodiment of a square grid connection element.

FIG. 37 is another 3×3 square grid connection element 370 that is different from the one shown in FIG. 36. Specifically, the channels have been modified so that not as many different attaching angles are available for a C-claw.

Figure 38A:
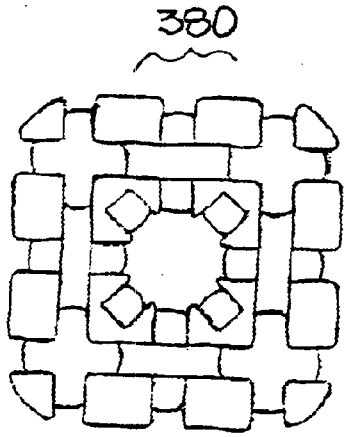
FIG. 38A is a top view of an alternative embodiment of a square grid connection element.
Figure 38B:
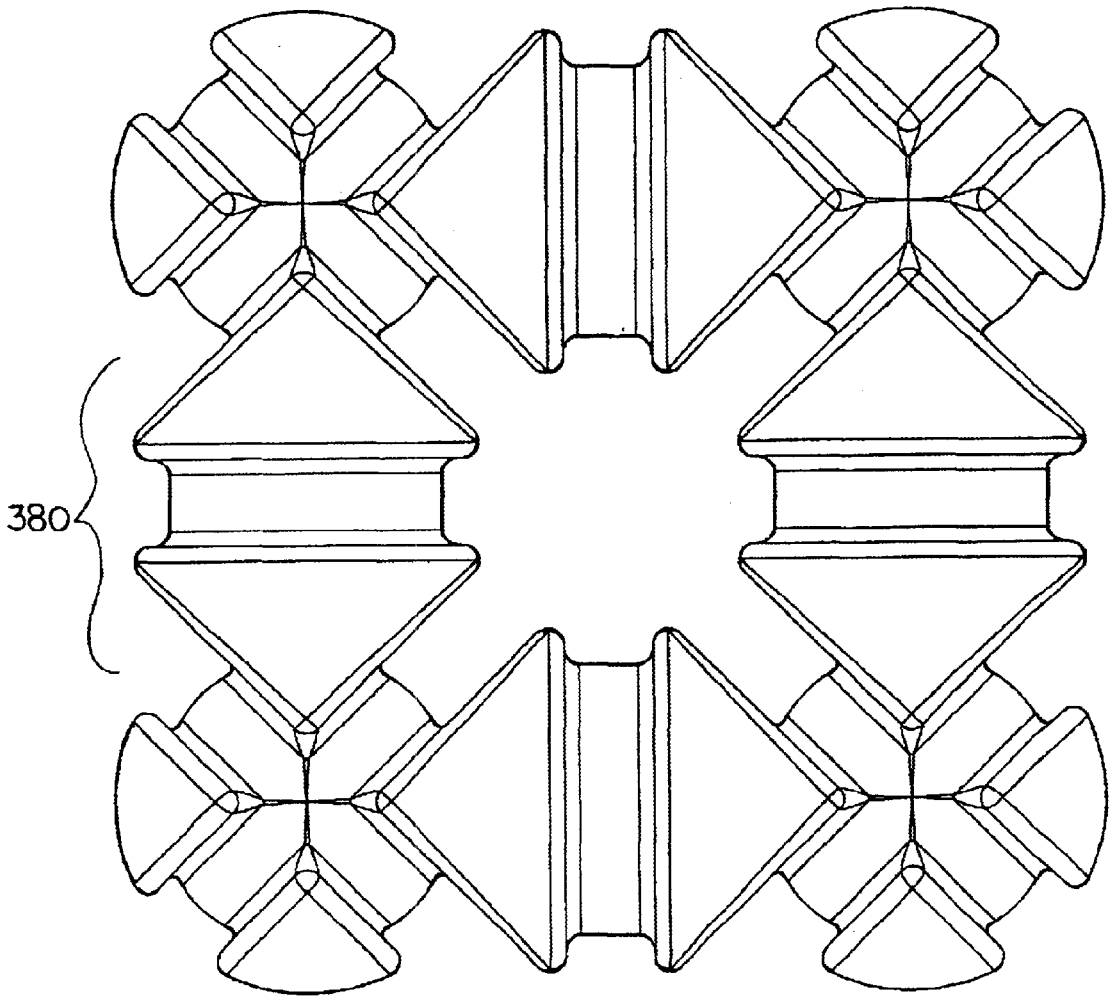
FIG. 38B is a perspective view of the square grid connection element of FIG. 38A.

FIG. 38A is a top elevational view of another 3×3 square grid connection element 380. FIG. 38B is a perspective view of the square grid connection element 380 of FIG. 38A. The purpose of FIGS. 36, 37, 38A and 38B are to illustrate that there are many changes that can be made to these square grid connection elements 360, 370, and 380, and still provide substantial functionality.

Figure 39:
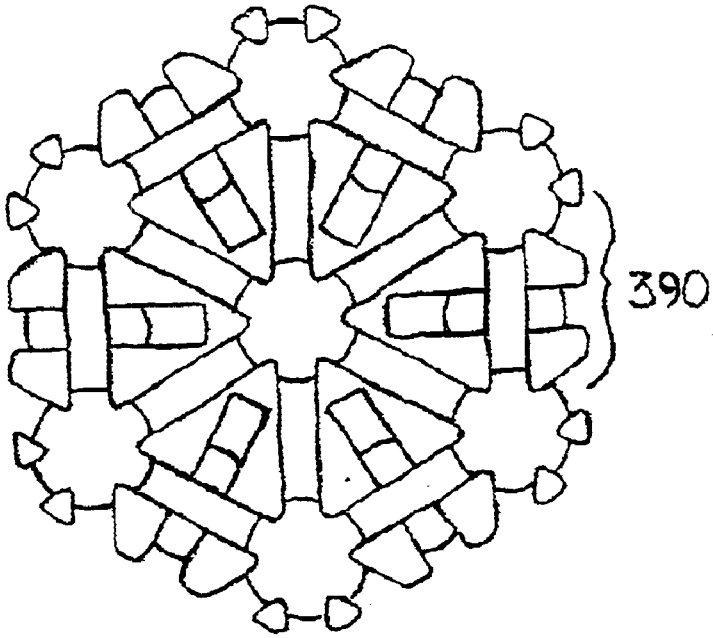
FIG. 39 is a top view of a hexagonal grid connection element.
Figure 40:
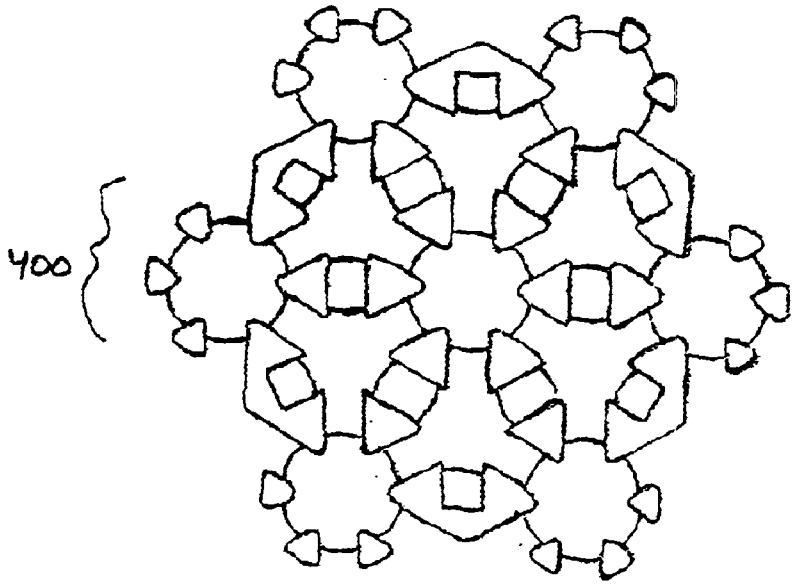
FIG. 40 is a top view of an alternative embodiment of a hexagonal grid connection element.
Figure 41:
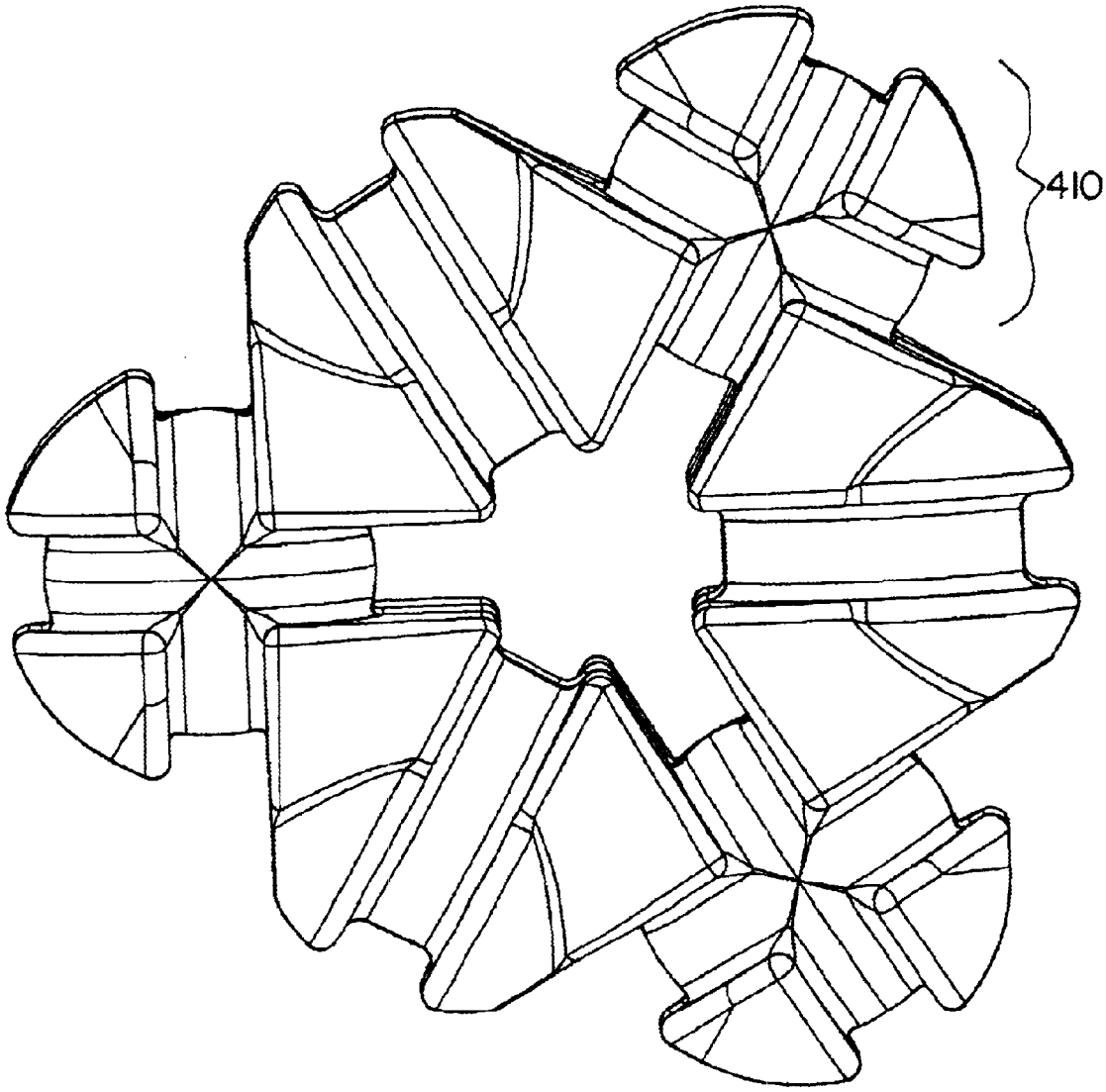
FIG. 41 is a perspective view of a triangular grid connection element.

FIG. 39 is a top elevational view of a 6-sided hexagonal grid connection element 390. Another hexagonal grid connection element 400 is shown in FIG. 40. Finally, a smaller triangular grid connection element 410 is shown in FIG. 41. It should also now be apparent that the great variety of configurations possible for the construction elements are due in a substantial part to the inclusion of the ball structures in the grids.

Figure 42:
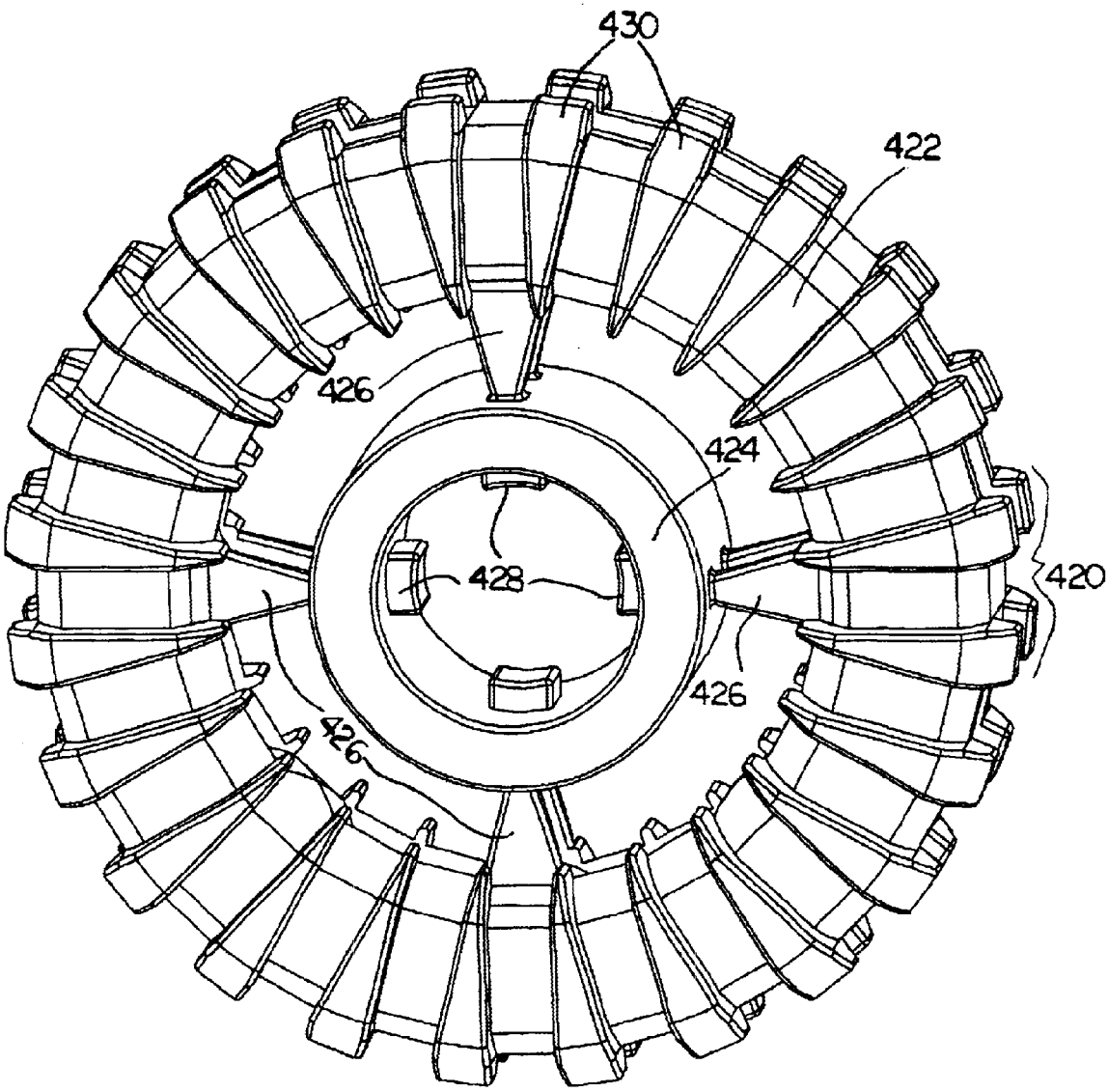
FIG. 42 is a perspective view of a wheel construction element.

FIG. 42 is a perspective view of a wheel 420. The wheel 420 is comprised of an outer rim 422 and an inner hub 424. The hub 424 is coupled to the outer rim 422 via spokes 426. The hub 424 includes a plurality of projections 428 that project inwards toward a center of the wheel 420. Along the outer rim 422 are a plurality of channels 430 that can serve different useful functions. For example, the channels 430 can function as gear teeth, or channel guides for a C-claw to connect thereto.

Figure 43:
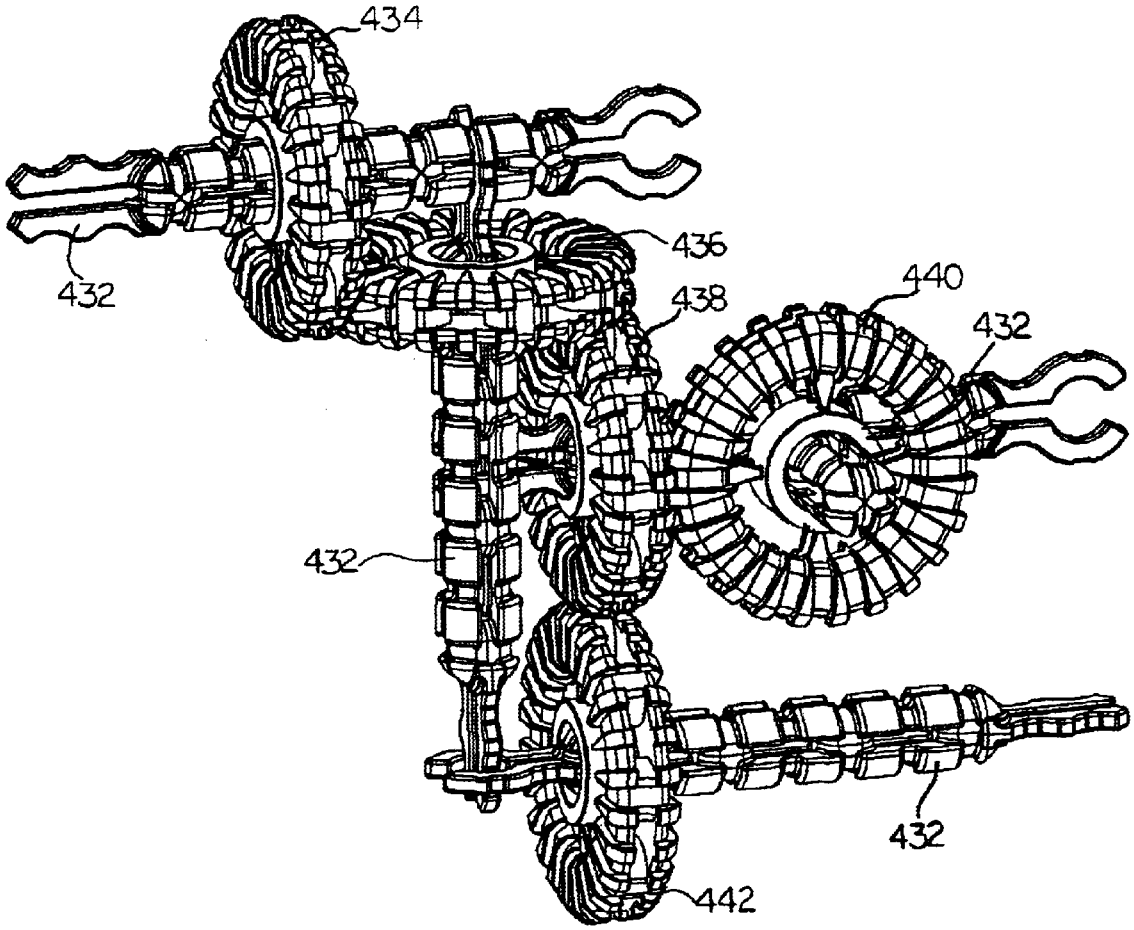
FIG. 43 is a perspective view of a plurality of wheel construction elements coupled to a plurality of cylindrical struts and forming a gear transfer configuration.

FIG. 43 is provided as a perspective view of a plurality of wheels 420 that are coupled in various manners to a plurality of cylindrical struts 432. It should be observed that the projections 428 shown in FIG. 42 enable the wheels 420 to remain between the channel guides, and thus rotate around a long axis of the plurality of cylindrical struts 432. Notice also that a first wheel 434 engages second wheel 436 using the channels 430. Likewise, second wheel 436 engages third wheel 438, which in turn engages fourth wheel 440 and fifth wheel 442. In other words, the plurality of wheels 420 form a gear transfer configuration.

Figure 44A:
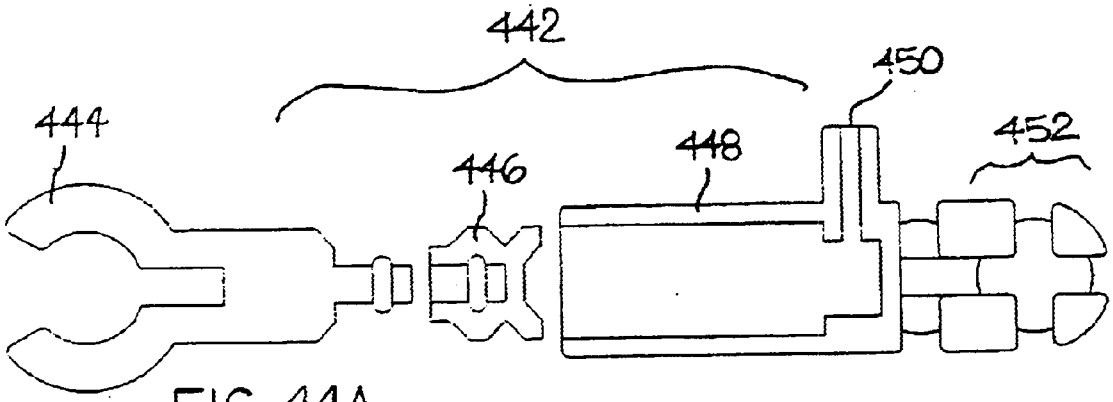
FIG. 44A is a profile cut-away view of the components in the presently preferred embodiment of a pneumatic ram, wherein the components are expanded.
Figure 44B:
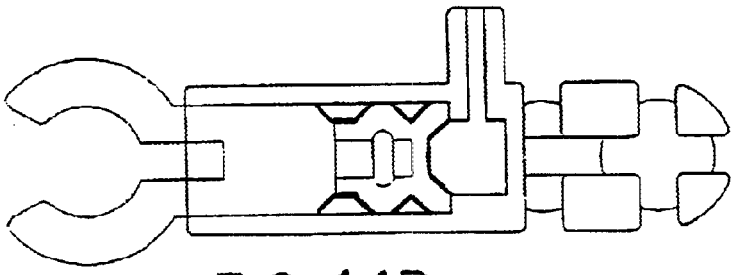
FIG. 44B is a profile cut-away view of the pneumatic ram of FIG. 44A where the components are compressed in a retracted position.

Because the motivation for creating the present invention was the desire to create a truly versatile construction playset, several specific components were designed to add extra functionality. FIG. 44A is a side profile cut-away view of the components that are needed in a preferred embodiment of a pneumatic ram 442. In this presently preferred embodiment, the pneumatic ram 442 includes a C-claw 444 on a first coupling end that is coupled to a piston 446, a ram body 448, a port 450 for the delivery and extraction of air from the pneumatic ram, and a second coupling end 452. The assembled pneumatic ram is shown in a retracted position in FIG. 44B.

Operation of the pneumatic ram 442 is relatively simple. A hose (not shown) is coupled to the port 450. The hose would deliver air to the ram body 448, pushing the piston 446, and thus driving the C-claw 444 outward from the ram body. Likewise, extracting air from the ram body 458 through the hose would draw the piston downwards into the ram body, and thus retract the C-claw 444. This particular addition to the construction elements should enable a user to animate certain models, shapes, patterns or designs.

Figure 44C:
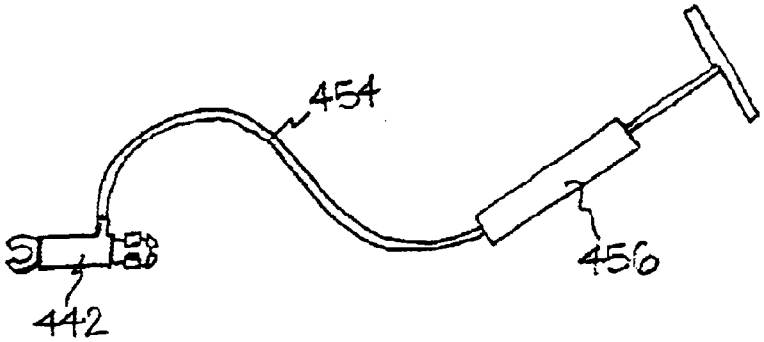
FIG. 44C is a profile view of a pneumatic pump with a hand pump coupled thereto for actuating the pneumatic pump.

FIG. 44C is provided as a profile view of the pneumatic ram 442 that is coupled via a hose 454 to a hand ram 456. A user would push on a handle of the hand ram 456 to cause the pneumatic ram 442 to actuate, and pull the handle back out of the hand ram 456 to retract the pneumatic ram 442.

Figure 45:
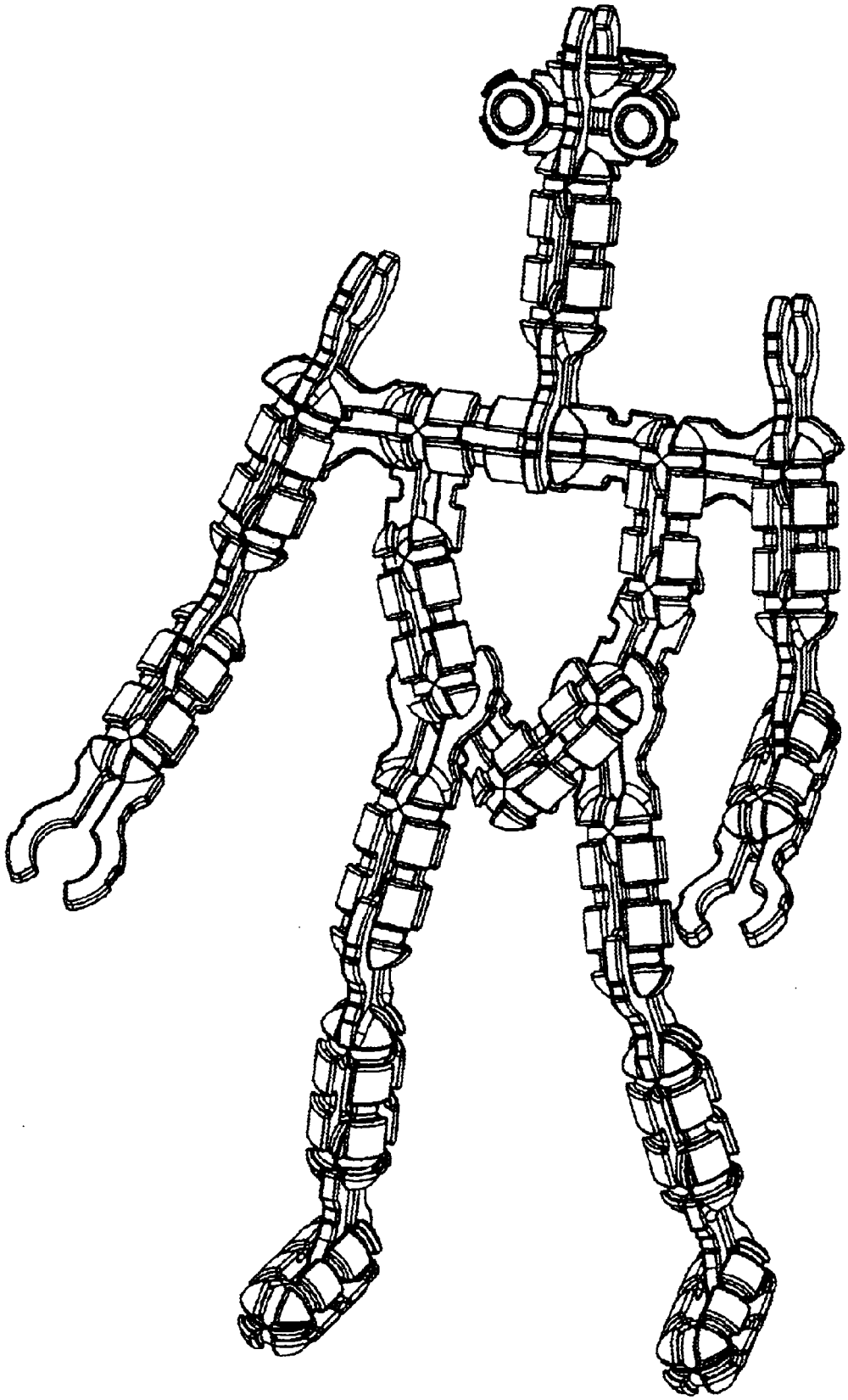
FIG. 45 is a perspective view of a toy robot created by coupling together a portion of the construction elements of the present invention.
Figure 46:
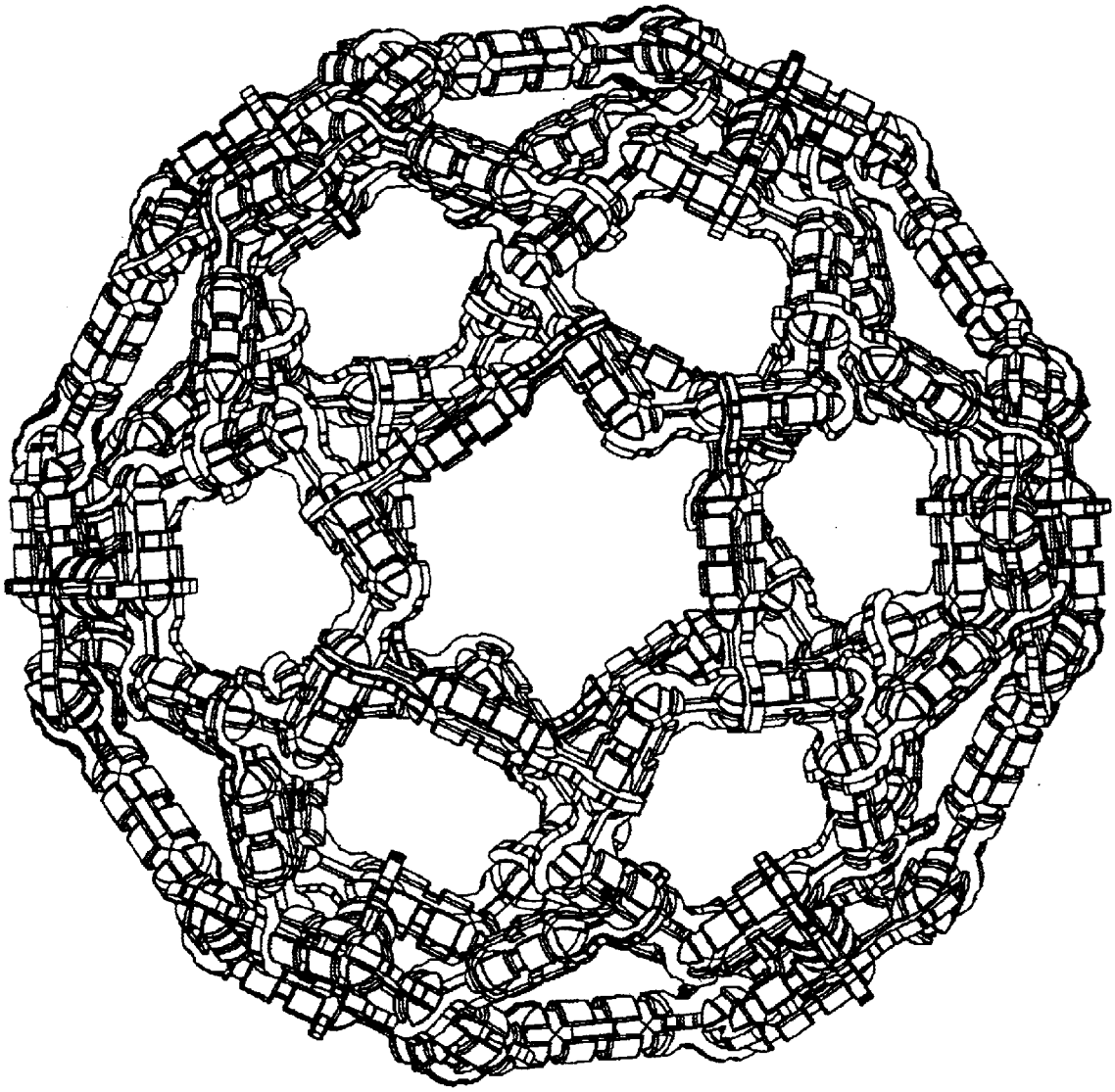
FIG. 46 is a perspective view of a polyhedron that is created by coupling together a portion of the construction elements of the present invention.

While it has been stated that the present invention makes possible the creation of models, shapes, patterns or designs, such objects have not yet been pictured. FIGS. 45 and 46 are offered simply as illustrations of possible models. FIG. 45 is a toy robot constructed using the construction elements of the preferred embodiment. Although not shown here, construction elements such as the pneumatic ram of FIGS. 44A–C can also be added to enable the toy robot to be animated, such as by moving a arms, legs or a head. The construction elements provide a user with substantial freedom to create many designs. For example, FIG. 46 is an elaborate polyhedron model that is patterned after a soccer ball design, also recognized as the chemical shape of the carbon molecule $C_{60}$, a bucky ball, or more specifically, a truncated icosahedron.

The present invention also includes the concept of having other ways of applying mechanical force. For example, a motor can be adapted to operate with the present invention using a simple system of gears, etc. Using the small holes that can be disposed along the lengths of planar struts or in the attaching ends of cylindrical struts, it is also possible to create a pulley system. A chain and sprocket system can also be used to apply mechanical force. The present invention also includes the ability to provide a switch. The switch can be pneumatic or electrical in nature.

When describing the materials used in manufacturing the construction elements, it has also been stated that they are comprised of a slightly flexible plastic material such as polypropylene or nylon that enables the construction elements to properly grasp and remain coupled together. In addition, it is envisioned that a more flexible material can be used in their construction. Accordingly, it is envisioned that the construction elements are capable of being very flexible, and therefore capable of wrapping around themselves or other construction elements. Such materials would also be polypropylene or nylon. Nevertheless, some constructions can also be constructed of wood and metal.

Figure 47:
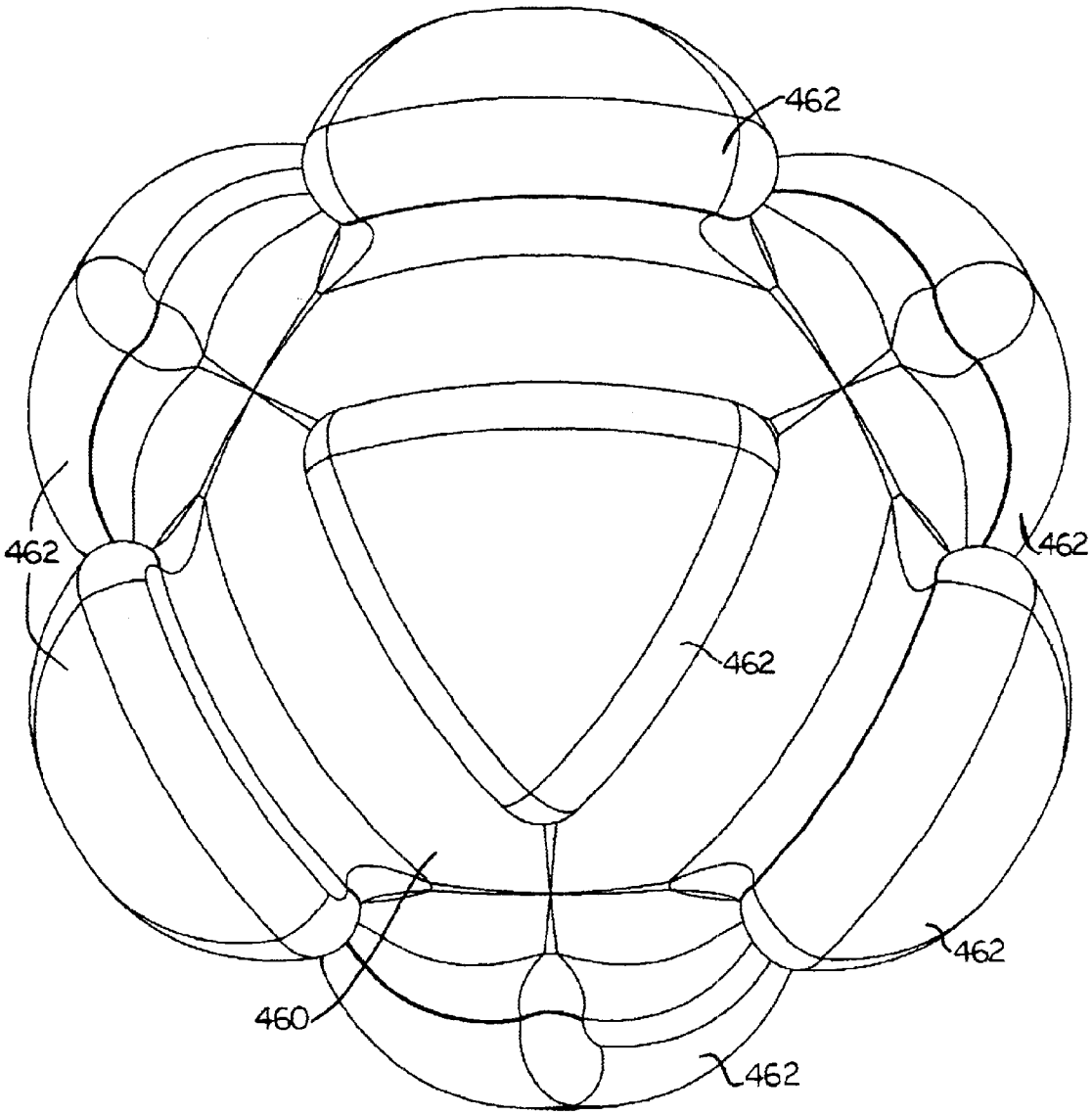
FIG. 47 is a three dimensional drawing of a round connector.

A last construction element to be described is shown in FIG. 47. FIG. 47 is a three dimensional perspective drawing of a round connector 460. The round connector 460 includes a plurality of protuberances 462 which extend outwards from the round connector. These protuberances 462 are shaped so that they can be coupled to other construction elements.

Figure 48:
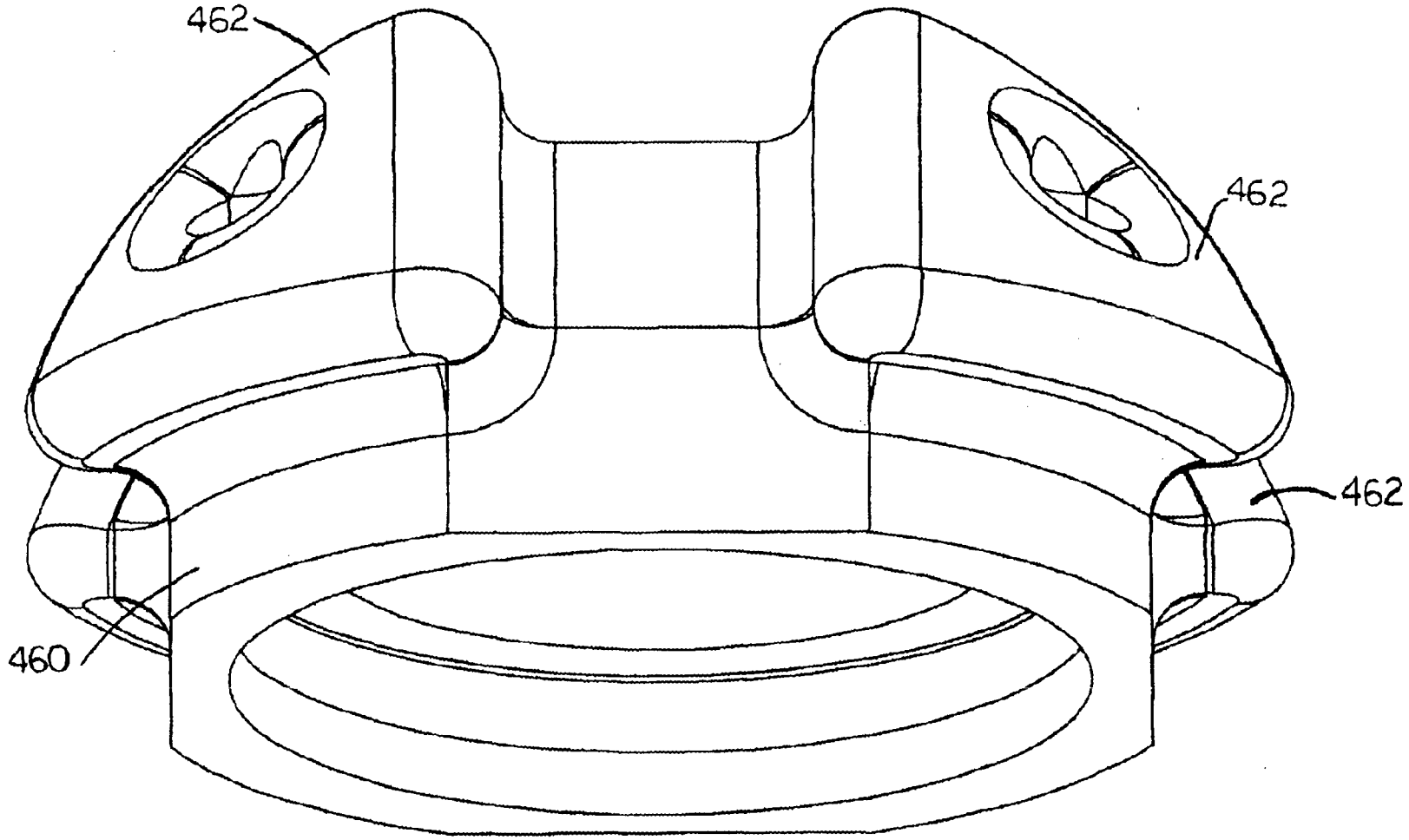
FIG. 48 is a three dimensional drawing of half of the round connector of FIG. 47 that illustrates the round connector being formed from two separate halves.

FIG. 48 is a three dimensional drawing of half of the round connector 460 of FIG. 47. The figure is provided to illustrate that in the presently preferred embodiment, the round connector 460 is formed from two separate halves in a mold. The two halves are then assembled by pushing them together until they snap into place. Thus, the round connector 460 is hollow. This feature is possible in many of the construction elements when they are manufactured in molds. Each mold forms a complementary half of a construction element that are snapped together. This can result in significant savings of construction materials.

It is to be understood that the above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

What is claimed is:

1. A planar construction toy formed of molded plastic, wherein the planar construction toy comprises:

a body member having a long axis, wherein the body member is an elongated and thin rectangular shape having a top side and a bottom side;

at least one aperture disposed in the body member from the top side to the bottom side, wherein the at least one aperture includes at least two indentations in a sidewall thereof;

an attaching mechanism on each end of the body member for coupling to other construction elements, wherein the attaching mechanism includes a slotted portion that extends from the attaching mechanism a predetermined distance along a length of the body member, and wherein the attaching mechanism includes a plurality of indentations disposed along an outer edge thereof, thereby enabling the attaching mechanism to reference and thereby engage other construction elements; and wherein the at least one aperture and the attaching mechanisms on each end of the body member are evenly spaced apart.

2. The planar construction toy as defined in claim 1 wherein each of the attaching mechanisms further comprises a C-claw shape, wherein an opening in the C-claw shape is disposed along the long axis of the body member.

3. The planar construction toy as defined in claim 2 wherein the plurality of indentations are disposed at 45 degrees and 90 degrees relative to the long axis of the body member.

4. The planar construction toy as defined in claim 3 wherein the at least one aperture is further comprised of at least two apertures disposed along the body member, wherein the at least two apertures are spaced evenly along the body member relative to the attaching mechanisms and each other.

5. The planar construction toy as defined in claim 4 wherein the planar construction toy further comprises a plurality of indentation pairs disposed along the length of the body member, wherein the plurality of indentation pairs are only disposed between apertures, always being one indentation pair less than a total number of apertures disposed along the body member.

6. The planar construction toy as defined in claim 5 wherein the plurality of indentation pairs are further comprised of beveled edges, wherein the beveled edges are beveled parallel to the long axis of the body member, and form a 45 degree angle.

7. The planar construction toy as defined in claim 6 wherein the planar construction toy further comprises at least one hole disposed through the body member from the top side to the bottom side, wherein the at least one hole is small relative to the at least one aperture.

8. The planar construction toy as defined in claim 1 wherein each of the attaching mechanisms further comprises an inverted claw shape, wherein an opening in the inverted claw shape is disposed along the long axis of the body member, and wherein the inverted claw shape comprises two arms that extend away from each other at ends thereof.

9. A cylindrical construction toy formed of molded plastic, wherein the cylindrical construction toy comprises:

a body member having a long axis, wherein the body member is comprised of at least two ball structures, wherein at least two joining members join the at least two ball structures, wherein the at least two joining members include at least one groove disposed perpendicular to the long axis, and wherein the at least two joining members are disposed equidistant from each other along a length thereof; and at least one aperture disposed between the at least two ball structures which is formed by the at least two joining members and the at least two ball structures.

10. The cylindrical construction toy as defined in claim 9 wherein the at least two joining members further comprise four joining members, wherein the four joining members are disposed equidistant from each adjacent joining member along a length thereof, wherein the four joining members form two apertures with the ball structures, wherein the two apertures are perpendicular to each other, and pass through a central axis of the body member.

11. The cylindrical construction toy as defined in claim 10 wherein the at least two ball structures further comprise at least one additional channel guide disposed thereon to form at least one groove in conjunction with the joining members.

12. The cylindrical construction toy as defined in claim 11 wherein the construction toy further comprises:

an attaching mechanism on each end of the body member for coupling to other construction elements, wherein the attaching mechanism includes a slotted portion that extends from the attaching mechanism a predetermined distance along a length of the body member; and wherein the at least two ball structures and the attaching mechanisms on each end of the body member are evenly spaced apart along the length of the body member.

13. The cylindrical construction toy as defined in claim 12 wherein each of the attaching mechanisms further comprises a C-claw shape, wherein an opening in the C-claw shape is disposed along the long axis of the body member.

14. The cylindrical construction toy as defined in claim 13 wherein the C-claw shape includes a plurality of indentations disposed along an outer edge thereof, thereby enabling the C-claw shape to reference and thereby engage other construction elements.

15. The cylindrical construction toy as defined in claim 14 herein the plurality of indentations are disposed at 45 degrees and 90 degrees relative to the long axis of the body member.

16. The cylindrical construction toy as defined in claim 15 wherein the planar construction toy further comprises at least one hole disposed through the attaching mechanism from a top side to a bottom side thereof, wherein the at least one hole is small relative to the at least one aperture.

17. The cylindrical construction toy as defined in claim 12 wherein each of the attaching mechanisms further comprises an inverted claw shape, wherein an opening in the inverted claw shape is disposed along the long axis of the body member, and wherein the inverted claw shape comprises two arms that extend away from each other at ends thereof.

18. A construction toy formed of molded plastic, wherein the construction toy forms a bolt and nut relationship with a cylindrical strut, said construction toy comprising:

a cylindrical portion that is just slightly larger than a diameter of a cylindrical strut;

a helical projection disposed on an inside wall of the cylindrical portion, wherein the helical projection is slightly smaller than a channel formed around a circumference of the cylindrical strut;

at least two handles coupled to the cylindrical portion, wherein the at least two handles enable the construction toy to be rotated about the cylindrical strut; and a ball structure disposed on an end of each of the at least two handles, to thereby provide an attaching mechanism thereon.

19. A planar construction toy formed of molded plastic, wherein the construction toy provides a plurality of coupling locations to enable other construction elements to be coupled thereto, said construction toy comprising:

at least three attaching mechanisms formed in a plane, and which are joined at a central location centered about a central axis, each of the attaching mechanisms providing a coupling location for the attachment of a compatible construction element;

each of the attaching mechanisms disposed equidistant around the central location;

a slot disposed in each of the attaching mechanisms which extends inwards but without reaching the central axis of the construction toy; and wherein the at least three attaching mechanisms are selected from the group of attaching mechanisms comprised of C-claw shapes, and inverted claws.

20. A molded plastic construction toy for use in a construction playset, said construction toy comprising:

a ball structure;

four rectangular posts disposed equidistant from each other and coupled to the ball structure so as to intersect a portion thereof, wherein the four rectangular posts are aligned around the ball structure so as to form corners of a cube having the ball structure at a center thereof, and wherein the four rectangular posts are spaced apart so as to provide gaps therebetween;

a cylindrical depression disposed in a bottom of each of the four rectangular posts; and a cylindrical projection disposed on a top of each of the four rectangular posts which is slightly smaller in diameter than the cylindrical depression.

21. The construction toy as defined in claim 20 wherein the construction toy further comprises a portion of a cylindrical projection disposed on each outer edge of the four rectangular posts, such that if no gap was present between each of the four rectangular posts, the cylindrical projection on each outer edge would form completed cylindrical projections.

22. A planar construction toy mini-platform formed of molded plastic, wherein the construction toy mini-platform provides a plurality of coupling locations to enable other construction elements to be coupled thereto, said construction toy comprising:

at least three ball structures; and at least three joining members which are coupled to the at least three ball structures, wherein each of the joining members is coupled to at least two of the ball structures, wherein the at least three ball structures and the at least three joining members define a plane, and wherein at least one aperture is disposed between any two ball structures, said aperture formed by the ball structures and the joining members.

23. A construction playset formed of molded plastic, wherein the construction playset is comprised of a plurality of planar struts and cylindrical struts, said construction playset comprising:

at least one planar strut comprising:

a body member having a long axis, wherein the body member is an elongated and thin rectangular shape having a top side and a bottom side;

at least one aperture disposed in the body member from the top side to the bottom side, wherein the at least one aperture includes at least two indentations in a sidewall thereof;

an attaching mechanism on each end of the body member for coupling to other construction elements, wherein the attaching mechanism includes a slotted portion that extends from the attaching mechanism a predetermined distance along a length of the body member; and wherein the at least one aperture and the attaching mechanisms on each end of the body member are evenly spaced apart; and at least one cylindrical strut comprising:

a body member having a long axis, wherein the body member is comprised of at least two ball structures, wherein at least two joining members join the at least two ball structures, wherein the at least two joining members include at least one groove disposed perpendicular to the long axis, and wherein the at least two joining members are disposed equidistant from each other along a length thereof; and at least one aperture disposed between the at least two ball structures which is formed by the at least two joining members and the at least two ball structures.

24. A spherical construction toy formed of molded plastic, wherein the spherical construction toy comprises:

a spherical body; and

A plurality of protuberances which are coupled to a surface of the spherical body, and which are spaced equidistantly from each other around the surface of the spherical body, wherein each of the plurality of the protuberances is formed to have a narrow base where it attaches to the spherical body, wherein each of the protuberances becomes broader as it extends further from the spherical body, and wherein each of the spherical protuberances forms a triangular shape at a furthermost distance from the spherical body.

* * * * *